US011607570B2

(12) United States Patent
Hulbert et al.

(10) Patent No.: US 11,607,570 B2
(45) **Date of Patent: *Mar. 21, 2023**

(54) LONG-TERM FIRE RETARDANT WITH CORROSION INHIBITORS AND METHODS FOR MAKING AND USING SAME

(71) Applicant: FRS Group, LLC, Rocklin, CA (US)

(72) Inventors: Dennis Hulbert, Grass Valley, CA (US); Robert J. Burnham, Incline Village, NV (US); Michael S. Schnarr, Sonora, CA (US); Gerald Geissler, Roseville, CA (US); David W. Wilkening, Ronan, MT (US); Joseph McLellan, Rocklin, CA (US)

(73) Assignee: FRS Group, LLC, Rocklin, CA (US)

( * ) Notice: Subject to any disclaimer, the term of this patent is extended or adjusted under 35 U.S.C. 154(b) by 17 days.

This patent is subject to a terminal disclaimer.

(21) Appl. No.: 17/213,780

(22) Filed: Mar. 26, 2021

(65) Prior Publication Data

US 2021/0213319 A1 Jul. 15, 2021

Related U.S. Application Data

(63) Continuation of application No. 16/894,214, filed on Jun. 5, 2020, now Pat. No. 10,960,249.

(Continued)

(51) Int. Cl.
*A62D 1/00* (2006.01)
*A62C 3/02* (2006.01)

(52) U.S. Cl.
CPC ..... *A62D 1/0028* (2013.01); *A62C 3/0228* (2013.01); *A62D 1/0042* (2013.01)

(58) Field of Classification Search
CPC ..... A62C 3/0228; A62D 1/0042
See application file for complete search history.

(56) References Cited

U.S. PATENT DOCUMENTS 2,759,924 A 8/1956 Touey
2,990,233 A 6/1961 Eugene et al.
(Continued)

FOREIGN PATENT DOCUMENTS

AU 2018435573 A1 3/2021
CA 2494914 C 1/2013
(Continued)

OTHER PUBLICATIONS

Àgueda Costafreda, Effects of long-term forest fire retardants on fire intensity, heat of combustion of the fuel and flame emissivity. Universitat Politècnica de Catalunya, 2009. 239 pages.
(Continued)

*Primary Examiner* — Peter F Godenschwager
(74) *Attorney, Agent, or Firm* — Smith Baluch LLP

(57) ABSTRACT

A forest fire retardant composition contains water and a retardant compound that includes a halide salt, a non-halide salt, a metal oxide, a metal hydroxide, or combinations thereof. The halide salt may be magnesium chloride, calcium chloride, or both. The magnesium chloride hydrate has a formula $MgCl_2(H_2O)_x$, wherein x is at least one of x=1, 2, 4, 6, 8, or 12. The calcium chloride hydrate has a formula $CaCl_2(H_2O)_x$, wherein x is at least one of 1, 2, 4, or 6. The composition may be in the form of a liquid concentrate or a final diluted product. The final diluted product is effective in suppressing, retarding, and controlling forest fires while exhibiting corrosion resistance and low toxicity.

14 Claims, 3 Drawing Sheets

200

Related U.S. Application Data

(60) Provisional application No. 63/024,040, filed on May 13, 2020, provisional application No. 62/989,350, filed on Mar. 13, 2020, provisional application No. 62/858,640, filed on Jun. 7, 2019.

(56) References Cited

U.S. PATENT DOCUMENTS

| | | | |
|---|---|---|---|
| 3,342,749 | A | 9/1967 | Handleman et al. |
| 3,382,186 | A | 5/1968 | Silverstein |
| 3,409,550 | A | 11/1968 | Gould |
| 3,585,135 | A | 6/1971 | Smith et al. |
| 3,843,525 | A | 10/1974 | Hattori et al. |
| 4,134,876 | A | 1/1979 | Horner et al. |
| 4,134,959 | A | 1/1979 | Menke et al. |
| 4,145,296 | A | 3/1979 | Fox et al. |
| 4,168,239 | A | 9/1979 | Mertz et al. |
| 4,343,854 | A | 8/1982 | Moorman |
| 4,374,171 | A | 2/1983 | McCarter |
| 4,392,994 | A | 7/1983 | Wagener |
| 4,770,794 | A | 9/1988 | Cundasawmy et al. |
| 4,950,410 | A | 8/1990 | Pennartz |
| 4,983,326 | A | 1/1991 | Vandersall |
| 5,009,710 | A | 4/1991 | Bewsey |
| 5,596,029 | A | 1/1997 | Goebelbecker et al. |
| 5,849,210 | A | 12/1998 | Pascente et al. |
| 5,985,013 | A | 11/1999 | Kofler et al. |
| 6,019,176 | A | 2/2000 | Crouch |
| 6,162,375 | A | 12/2000 | Crouch et al. |
| 6,296,781 | B1 | 10/2001 | Amiran |
| 6,447,697 | B1 | 9/2002 | Vandersall |
| 6,517,747 | B2 | 2/2003 | Vandersall |
| 6,802,994 | B1 | 10/2004 | Kegeler et al. |
| 6,858,567 | B2 | 2/2005 | Akao |
| 7,115,677 | B2 | 10/2006 | Harashina et al. |
| 7,794,688 | B2 | 9/2010 | Caine et al. |
| 8,212,073 | B2 | 7/2012 | Kasowski |
| 8,871,058 | B2 | 10/2014 | Sealey et al. |
| 9,919,174 | B2 | 3/2018 | Vellmar |
| 9,982,195 | B2 | 5/2018 | Matsui |
| 10,550,483 | B2 | 2/2020 | Khosla et al. |
| 10,590,257 | B2 | 3/2020 | Appel et al. |
| 10,752,840 | B2 | 8/2020 | Cha et al. |
| 10,960,249 | B2 | 3/2021 | Hulbert et al. |
| 10,960,250 | B2 | 3/2021 | Hulbert et al. |
| 10,960,251 | B1 | 3/2021 | Hulbert et al. |
| 11,041,063 | B2 | 6/2021 | Hulbert et al. |
| 11,344,760 | B2 * | 5/2022 | Hulbert ..... A62D 1/005 |
| 11,395,934 | B2 | 7/2022 | Hulbert et al. |
| 11,420,084 | B2 | 8/2022 | Hulbert et al. |
| 2002/0013403 | A1 | 1/2002 | Vandersall |
| 2003/0010507 | A1 | 1/2003 | Greiner et al. |
| 2004/0074650 | A1 | 4/2004 | Shiga |
| 2004/0124403 | A1 | 7/2004 | Parker et al. |
| 2005/0001197 | A1 | 1/2005 | Clark |
| 2008/0196908 | A1 | 8/2008 | Schaefer |
| 2010/0063180 | A1 | 3/2010 | Kang et al. |
| 2011/0089386 | A1 | 4/2011 | Berry et al. |
| 2011/0105649 | A1 | 5/2011 | Harada et al. |
| 2011/0213065 | A1 | 9/2011 | Giesseibach et al. |
| 2012/0219947 | A1 | 8/2012 | Yurkovetsky et al. |
| 2012/0292551 | A1 | 11/2012 | Klaffmo |
| 2013/0180738 | A1 | 7/2013 | Kim et al. |
| 2013/0264509 | A1 | 10/2013 | Shalev et al. |
| 2015/0352744 | A1 | 12/2015 | Zhang et al. |
| 2015/0368560 | A1 | 12/2015 | Pascal et al. |
| 2016/0030789 | A1 | 2/2016 | Cordani |
| 2016/0264687 | A1 | 9/2016 | Tran |
| 2017/0056698 | A1 | 3/2017 | Pai et al. |
| 2018/0037998 | A1 | 2/2018 | Khosla et al. |
| 2018/0282218 | A1 | 10/2018 | Mabey |
| 2019/0153321 | A1 | 5/2019 | Simonovic |
| 2019/0322939 | A1 | 10/2019 | Kennedy et al. |
| 2020/0109253 | A1 | 4/2020 | Appel et al. |
| 2020/0384298 | A1 | 12/2020 | Hulbert et al. |
| 2020/0384299 | A1 | 12/2020 | Hulbert et al. |
| 2021/0009787 | A1 | 1/2021 | Hulbert et al. |
| 2021/0213318 | A1 | 7/2021 | Hulbert et al. |
| 2021/0220687 | A1 | 7/2021 | Hulbert et al. |
| 2021/0309830 | A1 | 10/2021 | Hulbert et al. |
| 2022/0072355 | A1 | 3/2022 | Hulbert et al. |
| 2022/0080242 | A1 | 3/2022 | Hulbert et al. |
| 2022/0323809 | A1 | 10/2022 | Hulbert et al. |

FOREIGN PATENT DOCUMENTS

| | | | |
|---|---|---|---|
| CN | 1225344 | A | 8/1999 |
| CN | 1446993 | A | 10/2003 |
| CN | 102417196 | A | 4/2012 |
| CN | 107880857 | A | 4/2018 |
| CN | 112391176 | A | 2/2021 |
| WO | 2006132568 | A2 | 12/2006 |
| WO | 2010059508 | A1 | 5/2010 |
| WO | 2019163839 | A1 | 8/2019 |
| WO | 2020247775 | A1 | 12/2020 |
| WO | 2020247780 | A1 | 12/2020 |
| WO | 2022132246 | A1 | 6/2022 |
| WO | 2022132962 | A1 | 6/2022 |

OTHER PUBLICATIONS

Blakely, "Laboratory method for evaluating forest fire retardant chemicals." (1970). 150 pages.

Byrd et al., "Characterizing short-wave infrared fluorescence of conventional near-infrared fluorophores." Journal of biomedical optics 24.3 (2019): 035004. 6 pages.

Cellulose. Wikipedia Dec. 6, 2018, Accessed at https://en.wikipedia.org/w/index.php?title=Cellulose&oldid=872356598 on Aug. 19, 2020. 12 pages.

Ding et al., "Recent advances in near-infrared II fluorophores for multifunctional biomedical imaging." Chemical science 9.19 (2018): 4370-4380.

Ecological Risk Assessment of Wildland Fire-Fighting Chemicals: Long-Term Fire Retardants. United States Forest Service Sep. 2017. Accessed at https://www.fs.fed.us/rm/fire/wfcs/documents/EcoRA-Retardants-ExecSummary_2017.pdf. 3 pages.

Evaluation of Wildland Fire Chemicals Standard Test Procedures STP 1.5—Fish Toxicity. USFS May 7, 2007. Accessed at https://www.fs.fed.us/rm/fire/wfcs/tests/documents/stp_01_5.pdf. 2 pages.

Fischel, "Evaluation of selected deicers based on a review of the literature." The SeaCrest Group, Report No. CDOT-DTD-R-2001-15 (Oct. 2001). 170 pages.

Fish Toxicity. US Forest Service Revised Sep. 6, 2017. Accessed at https://www.fs.fed.us/rm/fire/wfcs/performance/documents/FishTox_Foam.pdf. 2 pages.

Fiss et al., "Mechanochemical phosphorylation of polymers and synthesis of flame-retardant cellulose nanocrystals." ACS Sustainable Chemistry & Engineering 7.8 (2019): 7951-7959.

Hobbs, "Recent advances in bio-based flame retardant additives for synthetic polymeric materials." Polymers 11.2 (2019): 224. 31 pages.

Hollingbery et al., "The fire retardant behaviour of huntite and hydromagnesite—A review." Polymer degradation and stability 95.12 (2010): 2213-2225.

Huang et al., "Study on EPS thermal insulation mortar prepared by magnesium oxychloride cement." E3S Web of Conferences. vol. 198, EDP Sciences, 2020. 4 pages.

International Search Report and Written Opinion in International Patent Application No. PCT/US2020/036360 dated Nov. 30, 2020, 43 pages.

International Search Report and Written Opinion in International Patent Application No. PCT/US2020/036367 dated Sep. 9, 2020, 23 pages.

Invitation to Pay Additional Fees, and where Applicable, Protest Fee in International Patent Application No. PCT/US2020/036360 dated Aug. 24. 2020, 6 pages.

Mostashari et al., "Thermal decomposition pathway of a cellulosic fabric impregnated by magnesium chloride hexahydrate as a flame-retardant." Journal of thermal analysis and calorimetry 93.2 (2008): 589-594.

(56) References Cited

OTHER PUBLICATIONS

Mostashari et al., "XRD characterization of the ashes from a burned cellulosic fabric impregnated with magnesium bromide hexahydrate as flame-retardant." Journal of thermal analysis and calorimetry 92.3 (2008): 845-849.
Non-Final Office Action in U.S. Appl. No. 17/031,024 dated Feb. 4, 2021, 9 pages.
Non-Final Office Action in U.S. Appl. No. 16/894,231 dated Dec. 10, 2020, 10 pages.
Qu et al., "The synergism of MgCO3 and 2ZnCO3• 3ZnO• 4H2O as flame retardants and smoke suppressants for flexible poly (vinyl chloride)(PVC)." e-Polymers 11.1 (2011). 9 pages.
Specification for Long Term Retardant, Wildland Fire, Aircraft or Ground Application. US Department of Agriculture Forest Service Specification 5100-304b. Jan. 2000. Accessed at https://www.fs.fed.us/rm/fire/documents/304_b.pdf. 24 pages.
Specification for Long Term Retardant, Wildland Firefighting. US Department of Agriculture Forest Service Specification 5100-304d. Jan. 7, 2020. Accessed at https://www.fs.fed.us/rm/fire/wfcs/documents/51 00-304d_LTR_Final%20Draft_010720.pdf. 32 pages.
Specification for Long Term Retardant, Wildland Firefighting. US Department of Agriculture Forest Service Specification 5100-304c. Jun. 1, 2007. https://www.fs.fed.us/rm/fire/wfcs/documents/304c.pdf. 30 pages.
Walter et al., "Overview of flame retardants including magnesium hydroxide." Martin Marietta Magnesia Specialties (2015), 9 pages.
Wu et al., "Comparative performance of three magnesium compounds on thermal degradation behavior of red gum wood." Materials 7.2 (2014): 637-652.
Wu et al., "Flame retardancy and thermal degradation behavior of red gum wood treated with hydrate magnesium chloride." Journal of Industrial and Engineering Chemistry 20.5 (2014): 3536-3542.
Zhang et al., "Flame Retardancy of High-Density Polyethylene Composites with P, N-Doped Cellulose Fibrils." Polymers 12.2 (Feb. 5, 2020): 336. 15 pages.
U.S. Appl. No. 16/894,231, filed Jun. 5, 2020, Hulbert et al.
U.S. Appl. No. 17/215,091, filed Mar. 29, 2021, Hulbert et al.
U.S. Appl. No. 16/894,214, filed Jun. 5, 2020, Hulbert et al.
U.S. Appl. No. 17/105,019, filed Nov. 25, 2020, Hulbert et al.
U.S. Appl. No. 17/213,770, filed Mar. 26, 2021, Hulbert et al.
U.S. Appl. No. 17/031,024, filed Sep. 24, 2020, Hulbert et al.
U.S. Appl. No. 17/349,336, filed Jun. 16, 2021, Hulbert et al.
U.S. Appl. No. 17/214,266, filed Mar. 26, 2021, Hulbert et al.
Grevel et al., "Experimentally determined standard thermodynamic properties of synthetic MgSO4—4H2O (starkeyite) and MgSO4—3H2O: A revised internally consistent thermodynamic data set for magnesium sulfate hydrates." Astrobiology 12.11 (2012): 1042-1054.
Grevel et al., "Internally consistent thermodynamic data for magnesium sulfate hydrates." Geochimica et Cosmochimica Acta 73.22 (2009): 6805-6815.
International Search Report and Written Opinion in PCT/US21/63598 dated Mar. 2, 2022 27 pages.
International Search Report in International Patent Application No. PCT/US2021/047726 dated Feb. 3, 2022, 21 pages.
Invitation to Pay Additional Fees, and where Applicable, Protest Fee in International Patent Application No. PCT/US2021/047726 dated Nov. 9, 2021, 4 pages.
Perimeter Solutions, "Myth vs. Reality: Understanding the Chemistry of Wildfire Suppression" (Jun. 17, 2021), available at https://www.perimeter-solutions.com/wildfire-suppression-webinar/. 30 pages.

* cited by examiner

LONG-TERM FIRE RETARDANT WITH CORROSION INHIBITORS AND METHODS FOR MAKING AND USING SAME

CROSS-REFERENCE TO RELATED APPLICATIONS

This application is a continuation application of U.S. application Ser. No. 16/894,214, entitled "LONG-TERM FIRE RETARDANT WITH CORROSION INHIBITORS AND METHODS FOR MAKING AND USING SAME," which was filed on Jun. 5, 2020. U.S. application Ser. No. 16/894,214 claims a priority benefit to U.S. provisional application Ser. No. 62/858,640, filed on Jun. 7, 2019, 62/989,350 filed on Mar. 13, 2020, and 63/024,040 filed on May 13, 2020, which are incorporated herein by reference in their entirety.

BACKGROUND

Long-term retardants contain retardant salts that alter the way a forest fire burns, decrease the fire intensity, and slow the advance of the forest fire. Long-term retardants may be available as wet or dry concentrates that are mixed with water thereby improving water's effectiveness and ability to cling to fuels, over a long period of time. Long-term retardants may be colored with iron oxide, fugitive pigments, or remain uncolored.

In the "Ecological Risk Assessment of Wildland Fire-Fighting Chemicals: Long-Term Fire Retardants" (September 2017), hereby incorporated by reference in its entirety, the United States Forest Service ("USFS") has established a chemical toxicity risk assessment for fire-fighting chemicals currently approved for use by the USFS. The USFS uses a variety of fire-fighting chemicals to aid in the suppression of fire in wildlands. These products can be categorized as long-term retardants, foams, and water enhancers. This chemical toxicity risk assessment of the long-term retardants examines their potential impacts on terrestrial wildlife, plant, and aquatic species.

Further, in Specification 5100-304d (Jan. 7, 2020), Superseding Specification 5100-304b (July 1999), Superseding Specification 5100-00304a (February 1986), entitled "Specification for Long Term Retardant, Wildland Fire, Aircraft or Ground Application," hereby incorporated by reference in its entirety, the United States Department of Agriculture ("USDA") Forest Service has established the maximum allowable corrosion rates for 2024T3 aluminum, 4130 steel, yellow brass and Az-31-B magnesium. The corrosivity of forest fire retardants, in concentrate, to aluminum, steel, yellow brass and magnesium must not exceed 5.0 milli-inches ("mils") per year as determined by the "Uniform Corrosion" test set forth in Section 4.3.5.1 of the USDA Forest Service Specifications. The Forest Service Specifications identify the maximum amount of corrosion acceptable when both the retardant concentrate and its diluted solutions are exposed to each metal indicated above at temperatures of 70° Fahrenheit ("F") and 120° F. in both totally and partially immersed configurations. The maximum allowable corrosivity of aerially applied fire-retardant diluted solutions to aluminum is 2.0 mils per year ("mpy") and the maximum corrosivity to brass and steel is 2.0 mpy when partially immersed and 5.0 when tested in the partially immersed condition. In the partially immersed configurations, one-half of the coupon is within the solution and one-half is exposed to the vapors in the air space over the solution.

SUMMARY

The invention relates generally to fire retardant compositions and more particularly to long-term fire retardants suitable for use in direct or indirect attack of forest fires.

In one embodiment, a forest fire retardant composition is in the form of a liquid retardant solution that includes at least one retardant compound and water. The retardant compound may be a salt. The retardant salt may include at least one of magnesium chloride or calcium chloride. The salt is present in the composition from about 2% to about 70% by weight. The magnesium chloride hydrate has a formula $MgCl_2(H_2O)_x$, wherein x is at least one of x=1, 2, 4, 6, 8, or 12. Preferably, x=6. The calcium chloride hydrate has a formula $CaCl_2(H_2O)_x$, where x is at least one of x=1, 2, 4, or 6. The magnesium chloride and calcium chloride are present in the composition in a weight ratio (magnesium:calcium) from about 5%:95% to about 95%:5%, preferably from about 25%:75% to about 75%:25%, more preferably from about 50%:50%. The composition is effective in suppressing, retarding, and controlling forest fires while exhibiting corrosion resistance and low toxicity.

In another embodiment, a method of manufacture includes combining, via batch mixing or continuously mixing, (i) a liquid retardant solution including at least one of magnesium chloride or calcium chloride, (ii) a corrosion inhibitor, and (iii) a colorant.

In another embodiment, a method of manufacture includes receiving a forest fire retardant composition that includes a salt solution including at least one of magnesium chloride or calcium chloride, and diluting the composition with water, in one or more diluting steps, to achieve a final diluted product.

In another embodiment, a method of manufacture includes receiving a forest fire retardant composition that includes up to 100% salt solution with a salt concentration of about 5% to about 40% and may contain an additional bromine salt in a concentration of about 5% to about 50%. This embodiment includes diluting with water, in one or more diluting steps, to achieve a final diluted product.

In another embodiment, a method of combating a forest fire includes depositing, via aerial or ground-based application, a forest fire retardant composition containing a salt and water. The step of depositing includes at least one of a direct attack on the fire or an indirect attack before the fire. Combatting a forest fire includes at least one of suppressing, retarding, and/or controlling the forest fire.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTIONS OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

In General

Figure 1:
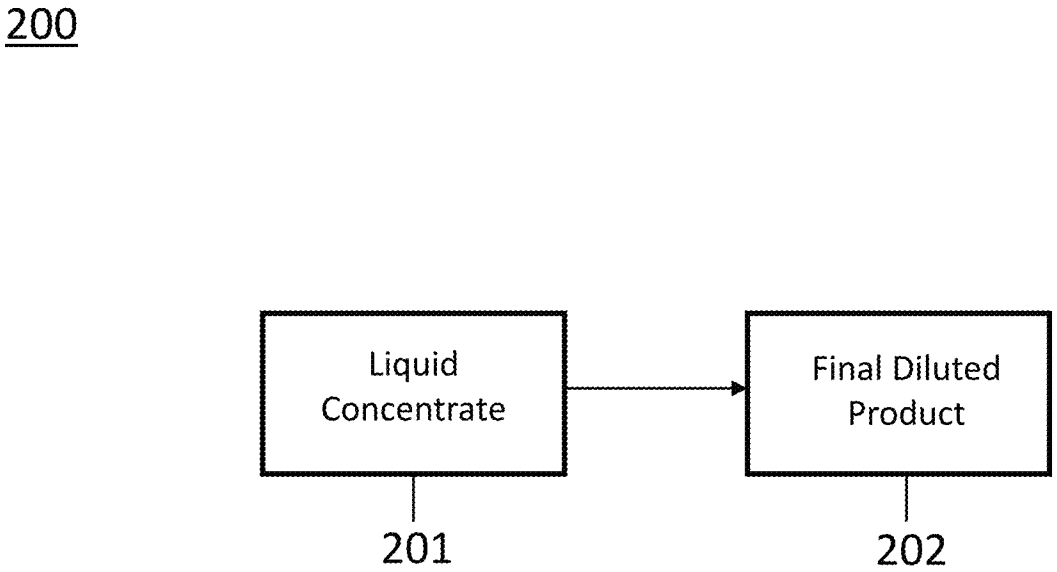
FIG. 1 is a flow chart diagram showing the process of making a forest fire retardant composition.

Referring to FIG. 1, a forest fire retardant composition 200 can be provided in various liquid forms. The composition 200 can be provided as a liquid concentrate 201. The composition 200 can also be provided as a final diluted product 202 in a form suitable to fight forest fires via aerial- or ground-based application. The final diluted product 202 is formed by diluting the liquid concentrate 201 with water in one or more diluting steps.

Components of the Liquid Concentrate

The forest fire retardant composition 200 includes one or more retardant compounds. The retardant compounds are preferably inorganic compounds. Table 1 below illustrates exemplary inorganic compounds, any one or more of which may be used, alone or in combination, as a retardant compound in the composition 200.

TABLE 1

Exemplary Inorganic Retardant Compounds

| Halide Salts | Non-Halide Salts | Other inorganic retardants |
|---|---|---|
| $MgCl_2$ | MgCO3 | MgO |
| $MgCl_2(H_2O)_x$ where x is 1, 2, 4, 6, 8, or 12 | $Mg_3(PO_4)_2$ | CaO |
| $CaCl_2$ | $Mg_5(CO_3)_4(OH)_2(H_2O)_4$ | $Na_2O$ |
| $CaCl_2(H_2O)_x$ where x is 1, 2, 4, or 6 | $Mg_3(PO_4)_2(H_2O)_8$ | $Li_2O$ |
| $MgBr_2$ | $CaCO_3$ | BaO |
| $CaBr_2$ | $Ca_3(PO_4)_2$ | $Mg(OH)_2$ |
| | $Mg_3Ca(CO_3)_4$ | $Ca(OH)_2$ |
| | $Ca_3(PO_4)_2(H_2O)_2$ | NaOH |
| | | LiOH |
| | | $Ba(OH)_2$ |
| | | KOH |

The retardant compound may be a salt. The salt may be a halide salt. The halide salt may include magnesium chloride. The magnesium chloride can be anhydrous, substantially free of any hydrate. Alternatively, or in combination with the anhydrous magnesium chloride, the magnesium chloride can be a hydrate, substantially free of any anhydrous. The hydrate may have the formula $MgCl_2(H_2O)_x$, where x is equal to at least one of 1, 2, 4, 6, 8, or 12. The magnesium chloride hydrate is preferably magnesium chloride hexahydrate having the formula $MgCl_2(H_2O)_6$.

Preferably, the magnesium chloride is present in the composition 200 in a magnesium chloride solution including magnesium chloride and water. The water may be tap water, sea water, or water from other convenient water sources. Prior to the addition of any water used to make the magnesium chloride solution, the magnesium chloride may be magnesium chloride anhydrous and/or magnesium chloride hydrate. In the liquid concentrate 201, the magnesium chloride solution is about 15% to about 45% $MgCl_2$ by weight, more preferably 20% to 45%, and particularly about 25% to about 35%. Preferably, the amount of magnesium chloride in the solution is at or near the maximum soluble limit of magnesium chloride. For example, the magnesium chloride solution in the liquid concentrate 201 is about 28% to about 32% by weight, and specifically about 30% $MgCl_2$ by weight. The magnesium chloride solution may be a corrosion inhibited magnesium chloride solution or a non-corrosion inhibited magnesium chloride solution. The magnesium chloride is a corrosion inhibited magnesium chloride solution when it includes a corrosion inhibitor in the magnesium chloride solution. The non-corrosion inhibited magnesium chloride solution does not include a corrosion inhibitor in the magnesium chloride solution. The magnesium chloride solution (corrosion inhibited or non-corrosion inhibited) may include, but is not limited to, magnesium chloride solution (CAS Number: 7786-30-3) or magnesium chloride hexahydrate (CAS Number: 7791-18-6) from Sigma Aldrich, or FreezGard Lite CI Plus, FreezGard Zero CI Plus, FreezGard Zero CI Plus LS, FreezGard CI Plus Sub Zero, FreezGard CI Plus, DustGuard, DustGard Plus, FreezGard Zero, FreezGard Lite, or MagnaPro from Compass Minerals or Hydro-Melt Green or HydroMelt Liquid Deicer from Cargill, or Iceban 200, Caliber M1000 AP, Meltdown with Shield AP, Meltdown APEX with Shield AP, FreezGard CI Plus, Ice B'Gone II HF, Ice Ban 305, FreezGard 0 CCI, Meltdown Apex, Meltdown Inhibited, ProMelt MAG 30 INH, ProMelt Ultra 1000 INH, NexGen Torch, or NexGen Liquid De-Icer. The magnesium chloride can be extracted from brine or sea water and may also contains small amounts of other salts and impurities. Alternatively, the magnesium chloride solution may be formed by the addition of water or other solvent to solid magnesium chloride anhydrous and/or magnesium chloride hydrate. The anhydrous halide salt and the hydrate halide salt may be present in the liquid concentrate 201 in any ratio that results in a solution halide salt weight percent between 20% to 38%, preferably between 25% to 33% magnesium halide salt.

Instead of (or in addition to) chlorine, the magnesium halide salt may include bromine as the halogen which forms a magnesium bromide salt. The bromine may be used alone in the magnesium halide salt; alternatively, the bromine may be used in combination with chlorine, thereby forming a mixture of magnesium bromide and magnesium chloride salts. The bromine salt, when used as a bromine flame retardant, has a mechanism that is similar to chlorine and may be used as a long-term fire retardant alone or in combination with chlorine. Halogens or other compounds that liberate stable radicals in the thermal environment of the flame front also operate with a mechanism that is similar to chlorine and may be used as a long-term fire retardant.

Instead of (or in addition to) magnesium chloride, the halide salt of the forest fire retardant composition 200 may be calcium chloride. The calcium chloride can be anhydrous, substantially free of any hydrate. Alternatively, or in addition to the anhydrous calcium chloride, the calcium chloride can be a hydrate, substantially free of any anhydrous. The hydrate may have the formula $CaCl_2(H_2O)_x$, where x is equal to at least one of 1, 2, 4, or 6. Preferably, the calcium chloride is present in the composition 200 in a calcium chloride solution including calcium chloride hydrate. Prior to the addition of any water used to make the calcium chloride solution, the calcium chloride may be calcium chloride anhydrous or calcium chloride hydrate. In the liquid concentrate 201, the calcium chloride solution is about 15% to about 45% $CaCl_2$, more preferably 20% to 45%, and particularly about 25% to about 35%. Preferably, the amount of calcium chloride in the solution is at or near the maximum soluble limit of calcium chloride. For example, the calcium chloride solution in the liquid concentrate 201 is about 28% to about 32%, and specifically about 30% $CaCl_2$. The calcium chloride solution may be a corrosion inhibited calcium chloride solution or a non-corrosion inhibited calcium chloride solution. The calcium chloride is a corrosion inhibited calcium chloride solution when it includes a corrosion inhibitor in the calcium chloride solution. The non-corrosion inhibited calcium chloride solution does not include a corrosion inhibitor in the calcium chloride solution. The calcium chloride solution (corrosion inhibited or non-corrosion inhibited) may include, but is not limited to, calcium chloride (CAS Number: 10043-52-4) from Sigma Aldrich, Liquid Dow Armor, Winter Thaw DI, Corguard TG, Road Guard Plus, Calcium Chloride with Boost (CCB), MeltDown Apex-C, or C1000 Pro. The calcium chloride can be extracted from brine or sea water and may also contains small amounts of other salts and impurities. Alternatively, the calcium chloride solution may be formed by the addition of water or other solvent to solid calcium chloride anhydrous and/or calcium chloride hydrate. The anhydrous halide salt and the hydrate halide salt may be present in the composition in any ratio that results in a solution halide salt concentration between 20% to 60%, preferably between 25% to 45% calcium halide salt.

In the liquid concentrate 201, the weight percent of magnesium chloride (including any hydrate(s)): calcium chloride (including any hydrate(s)) is about 0%:100% to about 100%:0%, preferably about 10%:90% to about 90%:10%, more preferably about 25%:75% to about 75%:25%, and particularly around 45%:55% to about 55%:45%. For example, the weight percent of magnesium:calcium is about 50%:50%. The calcium chloride forest fire retardant composition may be used for a liquid concentrate. The calcium halide salt may include bromine as the halogen which forms a calcium bromide salt. The bromine may be used alone in the calcium salt; alternatively, the bromine may be used in combination with chlorine, thereby forming a mixture of calcium bromide and calcium chloride salts.

Instead of (or in addition to) the halide salt, the salt of the forest fire retardant composition 200 may be a non-halide salt including at least one of magnesium non-halide salt, calcium non-halide salt, magnesium calcium non-halide salt, or a combination thereof. The anion in the salt may include at least one of carbonate or phosphate. The salt may include magnesium non-halide salt, which may be anhydrous magnesium non-halide salt or magnesium non-halide salt hydrate. The magnesium non-halide salt may include at least one of magnesium carbonate ($MgCO_3$), magnesium phosphate ($Mg_3(PO_4)_2$), magnesium carbonate hydroxide hydrate ($Mg_5(CO_3)_4(OH)_2(H_2O)_4$), or magnesium phosphate hydrate ($Mg_3(PO_4)_2(H_2O)_8$). As an alternative to using a magnesium non-halide salt, or in addition to using a magnesium non-halide salt, the non-halide salt may further include calcium non-halide salt, which may be anhydrous calcium non-halide salt or calcium non-halide salt hydrate. The calcium non-halide salt may include at least one of calcium carbonate ($CaCO_3$), calcium phosphate ($Ca_3(PO_4)_2$), huntite ($Mg_3Ca(CO_3)_4$), or calcium phosphate hydrate ($Ca_3(PO_4)_2(H_2O)_2$). The magnesium non-halide salt and calcium non-halide salt may be present in the forest fire retardant composition 200 in a weight ratio (magnesium: calcium) from about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

In the forest fire retardant composition 200, the weight percent of halide salt (including both anhydrous and hydrate):non-halide salt (including both anhydrous and hydrate) may be about 0%:100% to about 100%:0%, preferably about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

In the liquid concentrate 201, the salt may be hydrated. In the liquid concentrate 201, the weight percent of liquid salt solution (including any hydrate(s)) is about 75% to about 100%, preferably about 80% to about 99.5%, more preferably about 85% to about 99%, and particularly about 90% to about 98.5%. For example, the weight percent of the liquid salt solution (including both anhydrous and hydrate) in the liquid concentrate 201 is about 92% to about 98%, and specifically about 96.5%±1.0%.

In the liquid concentrate 201, the weight percent of salt is about 10% to 70%, preferably about 15% to 55%, more preferably about 20% to about 50%, and particularly about 22% to about 45%. For example, the weight percent of the salt in the liquid concentrate 201 is about 25% to about 40%, and specifically about 26% to about 33%.

Instead of (or in addition to) the salt, the forest fire retardant composition 200 may contain a retardant component that includes a metal oxide and/or metal hydroxide. It is understood that the metal oxide, in the presence of water, can undergo a reversible reaction with water to form a metal hydroxide. The metal oxide includes magnesium oxide (MgO), calcium oxide (CaO), sodium oxide ($Na_2O$), lithium oxide ($Li_2O$), and barium oxide (BaO). The metal hydroxide includes magnesium hydroxide ($Mg(OH)_2$), calcium hydroxide, ($Ca(OH)_2$), sodium hydroxide (NaOH), lithium hydroxide (LiOH), barium hydroxide ($Ba(OH)_2$), or potassium hydroxide (KOH).

In the liquid concentrate 201, the weight percent of metal hydroxide:salt (including halide and non-halide salt) is about 0%:100% to about 100%:0%, including about 5%:95%, 10%:90%, 15%:85%, 20%:80%, 25%:75%, 30%:70%, 35%:65%, 40%:60%, 45%:55%, 50%:50%, 55%:45%, 60%:40%, 65%:35%, 70%:30%, 75%:25%, 80%:20%, 85%:5%, 90%:10%, 95%:5%, and any range between any two such ratios.

The forest fire retardant composition 200 includes water or another solvent. The water in the liquid composition 200 may be tap water or water from other convenient water sources. Preferably, the water or other solvent is present in the composition 200 in the magnesium chloride or calcium chloride solution.

The forest fire retardant composition 200 may further include a corrosion inhibitor. The corrosion inhibitor includes an inhibitor for the magnesium chloride, calcium chloride, and an inhibitor for brass, iron, aluminum, steel, copper, or magnesium. The corrosion inhibitor for magnesium may include COBRATEC 928, Denatonium benzoate, benzoic acid, Diammonium phosphate, monoammonium phosphate, Wintrol SB 25Na, or a combination of the above. The corrosion inhibitor may include one or more azoles. The corrosion inhibitor may be a Wintrol® Super Azole Mix (Wintrol® SAM-H90 from Wincom, Inc). The Wintrol® SAM-H90 is designed for aqueous application. Wintrol® SAM-H90 provides corrosion resistance in highly corrosive environments caused by halogens, such chloride. Optionally, Wintrol® SAM-H38Na may be used as the corrosion inhibitor, alone or in combination with Wintrol® SAM-H90. The corrosion inhibitor may include but is not limited to sodium selenite, sodium stearate, sodium benzoate, sodium fluoride, sodium phosphate, magnesium phosphate, benzotriazole-5-carboxcylic acid, benzotriazole, 1,8- napthalaldehydic acid, octadecylphosphonic acid, sodium dodecyl sulfonate (SDBS), Wintrol® BBT-25Na, Wintrol® BBT, Wintrol® THT-T, Wintrol® THT-35PG, Wintrol® THT-50K, Wintrol® SAM-H90, Wintrol SB 25Na, Wintrol® SAM-H38Na, Wintrol® SAM-H40(OS), Wintrol® SAM-B90, berberine, pyrrolidine riccione, catechin, lysergic acid, carmine, fast green, aniline, triethanolamine, p-chloroaniline, p-nitroaniline, p-methoxyaniline, p-methylaniline, sodium silicate, or a combination of the above.

The weight percent of the corrosion inhibitor, relative to the amount of the retardant compound in the liquid composition 200, is about 0.25% to about 5.0%, preferably about 0.5% to about 4.5%, more preferably about 0.75% to about 4.0%, and specifically about 1.0% to about 3.5%. For example, the weight percent of the corrosion inhibitor, relative to the amount of retardant compound in the composition 200, is about 1.25% to about 3.0%, and specifically about 2.0%±0.5%.

To control the viscosity of the composition 200, the composition 200 may also include at least one thickening agent. The thickening agent may be a polyurethane, a polyvinyl alcohol, an acrylic polymer, a gum, a cellulosic, a sulfonate, a polyurethane, a saccharide, a clay, an organosilicone, or a protein, including but not limited to latex, styrene, butadiene, polyvinyl alcohol, attapulgite, bentonite, montmorillonite, algin, collagen, casein, albumin, castor oil, cornstarch, arrowroot, yuca starch, carrageenan, pullulan, konjac, alginate, gelatin, agar, pectin, carrageenan, xanthan gum, guar gum, cellulose gum, acacia guar gum, locust bean gum, acacia gum, gum tragacanth, glucomannan polysaccharide gum, alginic acid, sodium alginate, potassium alginate, ammonium alginate, calcium alginate, chitosan, carboxymethyl cellulose (CMC), methyl cellulose, hydroxyethyl cellulose (HEC), hydroxymethyl cellulose (HMC), hydroxypropyl methylcellulose (HPMC), ethylhydroxymethyl cellulose, hypromellose (INN), cetyl alcohol, cetearyl alcohol, polyethylene glycol (PEG), acrylic microgel, or acrylic amide wax. In the liquid concentrate 201, the weight percent of the thickening agent(s), relative to the amount of the retardant compound in the liquid concentrate 201, is about 0.25% to about 6.0%, preferably about 0.5% to about 5.5%, more preferably about 0.75% to about 5.0%, and specifically about 1.0% to about 4.5%. For example, the weight percent of the thickening agent(s), relative to the amount of the retardant compound in the composition 200, is about 1.25% to about 4.0%, and specifically about 2.3%±0.5%.

In one embodiment, the forest fire retardant composition 200 includes a first thickening agent. The first thickening agent may be a polysaccharide gum. The weight percent of the polysaccharide gum, relative to the amount of the retardant compound in the composition 200, is about 0.25% to about 6.0%, preferably about 0.5% to about 5.5%, more preferably about 0.75% to about 5.0%, and specifically about 1.0% to about 4.5%. For example, the weight percent of the polysaccharide gum, relative to the amount of the retardant compound in the composition 200, is about 1.25% to about 4.0%, and specifically about 2.3%±0.5%.

In another embodiment, the forest fire retardant composition 200 includes both the first thickening agent (discussed above) and a second thickening agent. The second thickening agent may be a chemically substituted cellulose or any other thickening agent listed above.

To control the pH of the composition 200, the composition 200 may also include buffering agents such as organic amines including but not limited to triethanolamine ($C_6H_{15}NO_3$), diethanolamine, monoethanolamine, or monoethylene glycol and strong bases including but not limited to magnesium hydroxide ($Mg(OH)_2$), calcium hydroxide, ($Ca(OH)_2$), sodium hydroxide (NaOH), lithium hydroxide (LiOH), barium hydroxide ($Ba(OH)_2$), or potassium hydroxide (KOH). The weight percent of the organic amine, relative to the amount of the retardant compound in the composition 200, is about 0.25% to about 5.0%, preferably about 0.5% to about 4.5%, more preferably about 0.75% to about 4.0%, and specifically about 1.0% to about 3.5%. For example, the weight percent of the organic amine, relative to the amount of the retardant compound in the composition 200, is about 1.25% to about 3.0%, and specifically about 2.0%±0.5%.

The weight percent of strong base, relative to the amount of the retardant compound in the composition 200, is about 0.05% to about 4.0%, preferably about 0.1% to about 4.5%, more preferably about 0.15% to about 4.0%, and more specifically about 0.2% to about 3.5%. For example, the weight percent of strong base, relative to the amount of the retardant compound in the composition 200, is about 0.25% to about 3.0%, and specifically about 1.1%±0.5%.

The composition 200 may also include surfactant components including but not limited to sodium dodecyl sulfate (SDS), sodium lauryl sulfate (SLS), sodium 4-dodecylbenzenesulfonate (SDBS), or a combination of the three, to reduce surface tension and increase the spreading and wetting properties of the forest fire retardant composition 200. The weight percent of surfactant, relative to the amount of the retardant compound in the composition 200, is about 0.005% to about 1.75%, preferably about 0.0075% to about 1.5%, more preferably about 0.01% to about 1.25%, and more specifically about 0.025% to about 1.0%. For example, the weight percent of surfactant, relative to the amount of the retardant compound in the composition 200, is about 0.05% to about 0.75%, and specifically about 0.12%±0.1%.

The composition 200 may also include adjuvants including but not limited to triethanolamine, propylene glycol, propylene carbonate, RJ-7033, RJ-7077, Silwet HS-312, Silwet HS-604, Silwet 625, Silwet 641, Silwet PD, polyethylene glycol, or polypropylene glycol, or a combination of the above.

The composition 200 may also include titanium dioxide. The titanium dioxide may act as a pigment, for example, to provide a white pigment. The titanium dioxide may also act as a photo-responsive material to create opacity by scattering light or by protecting the components of the forest fire retardant composition 200 from UV degradation. The weight percent of titanium dioxide, relative to the amount of the retardant compound in the composition 200, is about 0.02% to about 3.0%, preferably about 0.025% to about 2.75%, more preferably about 0.05% to about 2.5%, and more specifically about 0.1% to about 2.0%. For example, the weight percent of titanium dioxide, relative to the amount of the retardant compound in the composition 200, is about 0.2% to about 1.75%, and specifically about 0.97%±0.5%.

The composition 200 may also include a colorant. The colorant may be a fugitive colorant, a non-fugitive colorant, or a combination of the two. The composition 200 has a first hue which is a color, i.e., either colorless or a color which blends with the normal vegetation and/or ground in the drop zone. This first hue may be grey or white or a combination of the two. The colorant initially colors the composition 200 to a second hue which contrasts with the hue of the ground vegetation. The colorant may be a fugitive component such as a dye or a dye which is dispersed in a matrix (i.e., a pigment), which fades over time and under ambient field conditions to a colorless or less highly colored hue. Preferably the colorant is one that is compatible with magnesium chloride or calcium chloride such as colorants that have been used in de-icing, dust control, or fertilizers. The fugitive colorant may fade over time with exposure to sunlight.

Several fugitive component dyes and pigments can be used as a colorant. For example, many water-soluble dyes fade rapidly and there are so-called fluorescent pigments (fluorescent dyes encapsulated in a resin integument) which are suspended in forest fire retardant compositions and which also fade rapidly to provide a fugitive effect. Examples of fugitive dyes and pigments include, but are not limited to, C.I. Basic Red I dye, 6BL dye, Basic Violet II dye, Basic Yellow 40, acid fuchsin, basic fuchsin, new fuchsin, acid red 1, acid red 4, acid red 8, acid red 18, acid red 27, acid red 37, acid red 88, acid red 97, acid red 114, acid red 151, acid red 183, acid red 183, fast red violet 1B base, solvent red, Rhodamine B, Rhodamine 6G, Rhodamine 123, Rhodamine 110 chloride, erythrosine B, Basacryl red, Phloxine B, rose Bengal, direct red 80, direct red 80, Sudan red 7B, Congo red, neutral red, Fluorescent Red Mega 480, Fluorescent red 610, Fluorescent red 630, Fluorescent Red Mega 520, Pylaklor Red S-361, Pylaklor Scarlet LX-6364A Pylam Bright Red LX-1895 Pylam Coral LX-1801, FD&C Red #3, FD&C Red #4, FD&C Red #40, FD&C Red #4 Lake, D&C Red #33, D&C Red #33 Lake, and encapsulated-dye pigments which are available commercially, e.g., the "AX" series pigments, supplied by Day-Glo Color Corp., Cleveland, Ohio. The dye may be Liquitint 564 ($\lambda$=564 nm) or Liquitint Agro Pink 564 ($\lambda$=564 nm) from Milliken & Company (Spartanburg, S.C.).

The colorant may be a colorant from Greenville Colorants (New Brunswick, N.J.) or Milliken & Company (Spartanburg, S.C.). For example, the colorant is a colorant that is compatible for use with magnesium chloride, such as colorants used in magnesium chloride dust-control and road-stabilization formulations, or in magnesium chloride de-icing formulations. The colorant may be Elcomine Scarlet NAS, Elcomine Scarlaet NAS EX, or Iron Oxide GC-110P from Greenville Colorants. The colorant may be a combination of Liquitint 564 and Iron Oxide GC-110P.

The colorant of the composition 200 may be a dye or include encapsulated-dye fugitive pigments without ultraviolet absorbers. Compared to water soluble dyes, encapsulated-dye pigments are less likely to permanently stain the normal vegetation and/or ground in the drop zone. The fugitive component is present in an amount which provides a color (second hues) to the forest fire retardant composition 200 which is contrasts with the color of the vegetation and/or ground in the drop zone (normally green, blue-green and/or brown). Advantageously, the second hue is red, orange or pink. The color of the dye may be red, orange, purple, or pink or any combination of the four. Preferably, the dye is one that is compatible with magnesium chloride.

The colorant may also include a non-fugitive component, i.e., a component which is insoluble in the carrier liquid and which, if colored, does not necessarily fade after aerial application of the forest fire retardant composition 200. The non-fugitive component of the colorant is present in an amount sufficient to improve the aerial visibility of the composition when it is first applied to the vegetation. However, the non-fugitive component is present in less than an amount which prevents the composition from thereafter fading a neutral color. The colorant may be a combination of the fugitive and non-fugitive components. The non-fugitive component in the forest fire retardant composition 200 may be iron oxide ($Fe_2O_3$ or $Fe_3O_4$). The iron oxide may be present in combination with the fugitive colorant described above and titanium dioxide or it may be present alone.

The weight percent of colorant or Iron Oxide Black, relative to the amount of the retardant compound in the composition 200, is about 0.25% to about 6.0%, preferably about 0.5% to about 5.75%, more preferably about 0.75% to about 5.5%, and more specifically about 1.0% to about 5%. For example, the weight percent of colorant or Iron Oxide Black, relative to the amount of the retardant compound in the composition 200, is about 1.25% to about 4.5%, and specifically about 2.9%±1%.

The weight percent of dye, relative to the amount of the retardant compound in the composition 200, is about 0.02% to about 3.0%, preferably about 0.025% to about 2.0%, more preferably about 0.05% to about 1.5%, and more specifically about 0.075% to about 1.2%. For example, the weight percent of dye, relative to the amount of the retardant compound in the composition 200, is about 0.1% to about 1.0%, and specifically about 0.7%±0.4%.

The composition 200 may also include a glow-in-the-dark additive. The glow-in-the-dark additive improves the visibility of the fire retardant composition during periods of darkness. Nighttime visibility of the composition is improved, for example, to the naked human eye and/or using imaging equipment such as goggles. The glow-in-the-dark additive can include one or more phosphorescent additives that imparts photoluminescence properties to the forest fire retardant composition 200. The phosphorescent additive may exhibit fluorescence and/or phosphorescence. The phosphorescent additive may be charged with sunlight or artificial lighting, such as UV radiation or Fluorescent lighting. The phosphorescent additive may emit light in the visible light region or in the ultraviolet region. Alternatively, the phosphorescent additive may emit light in the near infrared region and be visualized using infrared goggles. Examples of the phosphorescent additive include LumiNova, LumiNova Green (G), LumiNova G PS-2, LumiNova Blue Green (BG), a zinc sulfide pigment, or mixtures thereof. The amount of the glow-in-the-dark additive, relative to the amount of composition 200 is about 100 g/1000 L to about 1000 g/1000 L, preferably about 200 g/1000 L to about 800 g/1000 L, and more preferably about 300 g/1000 L to about 700 g/1000 L. For example, the amount of the glow-in-the-dark additive, relative to the amount of composition 200 is about 350 g/1000 L to about 550 g/1000 L.

The glow-in the-dark additive may also include one or more fluorophores. The fluorophore(s) may exhibit fluorescence and/or phosphorescence. The fluorophore(s) may be visible in the near infrared region (i.e., 700 nm-1700 nm wavelength of light). Visualization can be achieved using near infrared goggles. Examples of fluorophores include CH1055 (4.8-Bis(2-(4-(bis(4-(2-carboxyethyl)phenyl) amino)phenyl)-5H-[1,2,5]thiadiazolo[3,4-f]benzo[c][1,2,5] thiadiazole), as well as Cy7 or Cy7.5, or mixtures thereof.

The composition 200 may optionally include other ingredients, such as spoilage inhibitors, flow conditioners, antifoaming agents, foaming agents, stability additives, biocide, thickening agents, surfactants, adjuvants, corrosion inhibitors other than those of the corrosion inhibiting system, opacifiers, additional coloring agents, liquid carrier, and water.

The components of the forest fire retardant composition 200 are batch mixed to form a liquid concentrate 201. Alternatively, the forest fire retardant composition 200 may be mixed using continuous mixing equipment. The mixing should be controlled to ensure that all of the dry components are adequately dispersed and hydrated to ensure that the formulation is maintained. The water in the liquid composition 201 may be tap water or water from other convenient water sources. The liquid composition 201 is chemically stable under normal temperatures and pressures. Once mixed, the liquid concentrate 201 is then stored, substantially in the absence of air and/or external moisture, in a sealed container. The liquid concentrate 201 should be protected from exposure to humidity and moisture. For example, the sealed container for storage and shipment to the point of use (e.g., airfield) may be a 1,000 L tote, a 5-gallon pail or a 55-gallon drum. The liquid concentrate 201 is chemically stable under normal temperatures and pressures.

The liquid concentrate 201 may be a viscous liquid concentrate. The viscosity may be in the range of 1500 cP to 2500 cP, and more preferably the viscosity may be about 1750 cP to 2250 cP at 70° F. For example, the viscosity of the liquid concentrate 201 may be about 1970 to 2090 cP at 70° F. The final diluted product 202 may alternatively be a high viscosity long term retardant through the addition of more thickening agent. The pH of the liquid concentrate 201 may be in the range of 5 to 7, and more preferably the pH may be 6.85 at 70° F. The freezing temperature of the liquid concentrate 201 may be in the range of −10° F. to 10° F., and more preferably the freezing temperature is 0° F.

The liquid concentrate 201 composition may include up to 100% hydrated salt. The hydrated salt may be at least one of magnesium chloride or calcium chloride. The salt weight percent of magnesium chloride hydrate or calcium chloride hydrate is about 5% to about 40%. The liquid concentrate 201 composition may also include additional bromine salt in a weight percent of about 5% to about 50%.

Instead of (or in addition to) the salt, the liquid concentrate 201 may include a metal oxide and/or a metal hydroxide. It is understood that the metal oxide, in the presence of water, can undergo a reversible reaction with water to form a metal hydroxide. The weight percent of metal hydroxide may be about 2% to about 60%, preferably about 5% to about 50%, more preferably about 7% to about 45%. For example, the concentration of metal hydroxide in the liquid concentrate 201 is about 8% to about 40%, and specifically about 30%±3%.

The liquid concentrate 201 may be supplied as part of a kit that includes a sealed container for storage and shipment, substantially in the absence of air and/or external moisture, (e.g., 1,000 L tote, a 5-gallon pail or a 55-gallon drum) and instructions for using the liquid concentrate 201 to form the final diluted product 202 (described below). Air-sealed bags with a plastic liner supplied by Semi-Bulk Systems Inc. (St. Louis, Mo.) can be used. Alternatively, an air-permeable moisture barrier can be used, such as a barrier made of a silicone material. In the case where the final diluted product 202 is to be applied on a localized scale by homeowners or local officials, for example, the kit may contain a tank for mixing and applying the final diluted product 202 (e.g., a 1-2 gallon hand-held or 4 gallon backpack or 5 gallon cart-style container with an applicator wand and/or hose, or a 15-25 gallon tank capable of being mounted on or pulled behind an all-terrain vehicle or truck), and instructions for using the liquid concentrate 201 to form and apply the final diluted product 202.

Forming the Final Diluted Product

The final diluted product 202 is formed by mixing the liquid concentrate 201 with water. The liquid concentrate 201 is shipped to the point of use (e.g., airfield), where it is diluted with water or other solvent to form the final diluted product 202. The liquid concentrate 201 may be designed for addition to water at a weight ratio of approximately 4.4 pounds of liquid concentrate 201 to one gallon of water. The water may be tap water or water from other convenient water sources. The product is mixed using the current mixing equipment available to the USFS. The liquid concentrate 201 is slowly added to a pre-measured and well-stirred tank of water to provide a finished ratio of 1.00:1.895 (liquid concentrate:water) on a weight/weight basis. The liquid concentrate 201 is very miscible in water and special mixing precautions are not necessary other than to limit splash escaping the mixing vessel. The tank contents should be circulated via a centrifugal pump or another stirring means to ensure uniform mixing.

The reaction is exothermic and may reach a maximum temperature between about 100° F. to about 110° F. The product is stirred for about 20-30 minutes before being allowed to stand to develop a stable viscosity and ensure a uniform mixture. The final diluted product 202 can also be prepared on a commercial batch scale by combining the liquid concentrate 201 with a measured amount of water in an appropriate mix vessel such as an agitated mix tank. Alternatively, the final diluted composition 202 may be prepared on a commercial batch scale using continuous mixing equipment. The rate of addition of liquid concentrate to water should be controlled to assure efficient mixing of the concentrate and the water. The final diluted product 202 forms a stable suspension and should be stirred after standing to eliminate any settling of the components.

The final diluted composition 202 can also be batch mixed by feeding the liquid concentrate 201 into a well-circulated mix-batch tank. Alternatively, the final diluted composition 202 may be mixed using continuous mixing equipment. Mix tank agitation may be provided via an overhead mechanical stirring apparatus or alternatively by a circulation pump sized to provide turbulent mixing. Alternatively, a venturi-type vacuum eductor mixer or an in-line high-shear mixer can be used. The final diluted product 202 is in a form suitable to fight forest fires via aerial- or ground-based application.

The liquid concentrate 201 may be diluted with water so that the final diluted product 202 has a salt concentration of about 200 grams to about 650 grams of salt per gallon of the final diluted product, preferably about 250 grams to about 600 grams of salt per gallon of the final diluted product, more preferably about 300 grams to about 550 grams of salt per gallon of the final diluted product. For example, the salt concentration in the final diluted product 202, is about 350 grams to about 500 grams of salt per gallon of the final diluted product, and specifically about 412±30 grams of salt per gallon of the final diluted product.

The liquid concentrate 201 may be diluted at about a 1.00:1.895 (liquid concentrate:water) on a weight/weight basis to form the final diluted product 202. The liquid concentrate 201 may be diluted with water so that the final diluted product 202 has about 200 grams to about 650 grams of salt per gallon of the final diluted product, preferably about 250 grams to about 600 grams of salt per gallon of the final diluted product, more preferably about 300 grams to about 550 grams of salt per gallon of the final diluted product. For example, the salt concentration in the final diluted product 202, is about 350 grams to about 500 grams of salt per gallon of the final diluted product, and specifically about 412±30 grams of salt per gallon of the final diluted product.

In the final diluted product 202, the weight percent of retardant compound (e.g., salt) is about 2% to about 70%, preferably about 5% to about 40%, more preferably about 7% to about 30%. For example, the concentration of retardant compound (e.g., salt) in final diluted product 202 is about 8% to about 15%, and specifically about 10%±2%.

The final diluted product 202 is a long-term non-fugitive forest fire retardant with improved aerial visibility for either a direct or indirect attack. The resulting final diluted product 202 is an opaque pink or red-purple suspension that resists settling. The final diluted product 202 should be mixed approximately every 7-10 days to ensure uniform density. The viscosity of the final diluted product 202 can be adjusted to accommodate a variety of aircrafts by adjusting the amounts of thickening agent(s) added to the mixture. The final diluted product 202 may be a medium viscosity long term retardant. The viscosity may be in the range of 100 cP to 250 cP, more preferably in the range of 150 cP to 220 cP, and more preferably the viscosity may be about 155 cP to 200 cP at 70° F. For example, the viscosity of the final diluted product 202 may be about 160 to 180 cP, for example about 170 cP. The final diluted product 202 may alternatively be a high viscosity long term retardant through the addition of more thickening agent.

Alternatively, the final diluted product 202 may be a low viscosity long term retardant through the use of less thickening agent. The pH of the final diluted product 202 may be in the range of 8 to 9, and more preferably the pH may be 8.20 at 70° F. The freezing temperature of the final diluted product 202 may be in the range of 15° F. to 25° F., and more preferably the freezing temperature is 18° F. Once blended with water, the final diluted product 202 is a homogeneous, stable fluid that requires only infrequent stirring. The final diluted product 202 is hydrated into a stable mixture in 20 minutes, without the use of special equipment.

EXAMPLES

Example 1

In Example 1, a liquid concentrate is prepared containing the amounts of ingredients listed in Table 2 below. The values in Table 2 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 2

Liquid Concentrate according to Example 1

| Ingredient | Weight Percent of Each Ingredient in Liquid Concentrate |
|---|---|
| 30% $MgCl_2$ Solution | 96.46% |
| Thickening agent 1 - Polysaccharide gum | 0.69% |
| Colorant - Iron Oxide Black | 0.84% |
| Magnesium Hydroxide | 0.32% |
| $TiO_2$ | 0.28% |

TABLE 2-continued

Liquid Concentrate according to Example 1

| Ingredient | Weight Percent of Each Ingredient in Liquid Concentrate |
|---|---|
| Triethanolamine ($C_6H_{15}NO_3$) | 0.58% |
| Corrosion inhibitor | 0.58% |
| Dye | 0.21% |
| SDS Surfactant | 0.04% |
| Total Weight of Liquid Concentrate | 100% |

The density of the liquid concentrate 201 of Example 1 at various temperatures is given in Table 3.

TABLE 3

Density of the liquid concentrate 201 at various temperatures

| Temperature (° F.) | Density (g/cm3) |
|---|---|
| 50 | 1.261 |
| 70 | 1.279 |
| 90 | 1.258 |

A final diluted product 202 of Example 1 is prepared by mixing 4.405 pounds of the liquid concentrate 201 with 1 gallon of water or 0.41 gallons of the liquid concentrate 201 with 1 gallon of water. The ratio of liquid concentrate:water is about 1.00:1.5 to about 1.00:2.5, for example, 1.00:1.895 to 1.00:2.43. The amounts of the ingredients in the final diluted product are listed in Table 4 below. The values in Table 4 can be varied by ±0.01%, or ±0.05%, or ±0.1%, or ±0.5%, or +1.0%, or +1.5%, or +2%, or +2.5%, or ±3.0%, or ±3.5%, or ±4.0%, or ±4.5%, or ±5.0%. The concentration of Example 1 is about 40% to 65% by weight in water, preferably about 45% to 60%, more preferably about 48% to 55%. For example, the concentration of Example 1 is about 53%. In Example 1, the weight percent of the liquid concentrate 201 relative to the total weight of the final diluted product 202 may be about 20% to about 50%, or about 25% to about 45%, or about 30% to about 40%, or about 35%±2%.

TABLE 4

Final Diluted Product according to Example 1

| Ingredient | Total grams/ gallon | Total pounds/ gallon |
|---|---|---|
| 30% $MgCl_2$ Solution | 1376.6281 | 3.0349 |
| Thickening agent 1 - Polysaccharide gum | 9.4987 | 0.0209 |
| Colorant - Iron Oxide Black | 11.9891 | 0.0264 |
| Magnesium Hydroxide | 4.5429 | 0.0100 |
| $TiO_2$ | 4.0266 | 0.0089 |
| Triethanolamine ($C_6H_{15}NO_3$) | 8.2598 | 0.0182 |
| Corrosion inhibitor | 8.2598 | 0.0182 |
| Dye | 2.9983 | 0.0066 |
| SDS Surfactant | 0.5038 | 0.0011 |
| Water | 2703.1772 | 5.9595 |
| Total Weight of Final Diluted Product | 4129.8843 | 9.1048 |
| Density of Final Diluted Product | 1.091 | 9.1050 |

The density of the final diluted product 202 of Example 1 at various temperatures is given in Table 5.

TABLE 5

Density of the final diluted product 202 at various temperatures

| Temperature (° F.) | Density (g/cm3) |
|---|---|
| 50 | 1.094 |
| 70 | 1.091 |
| 90 | 1.088 |

Figure 2:
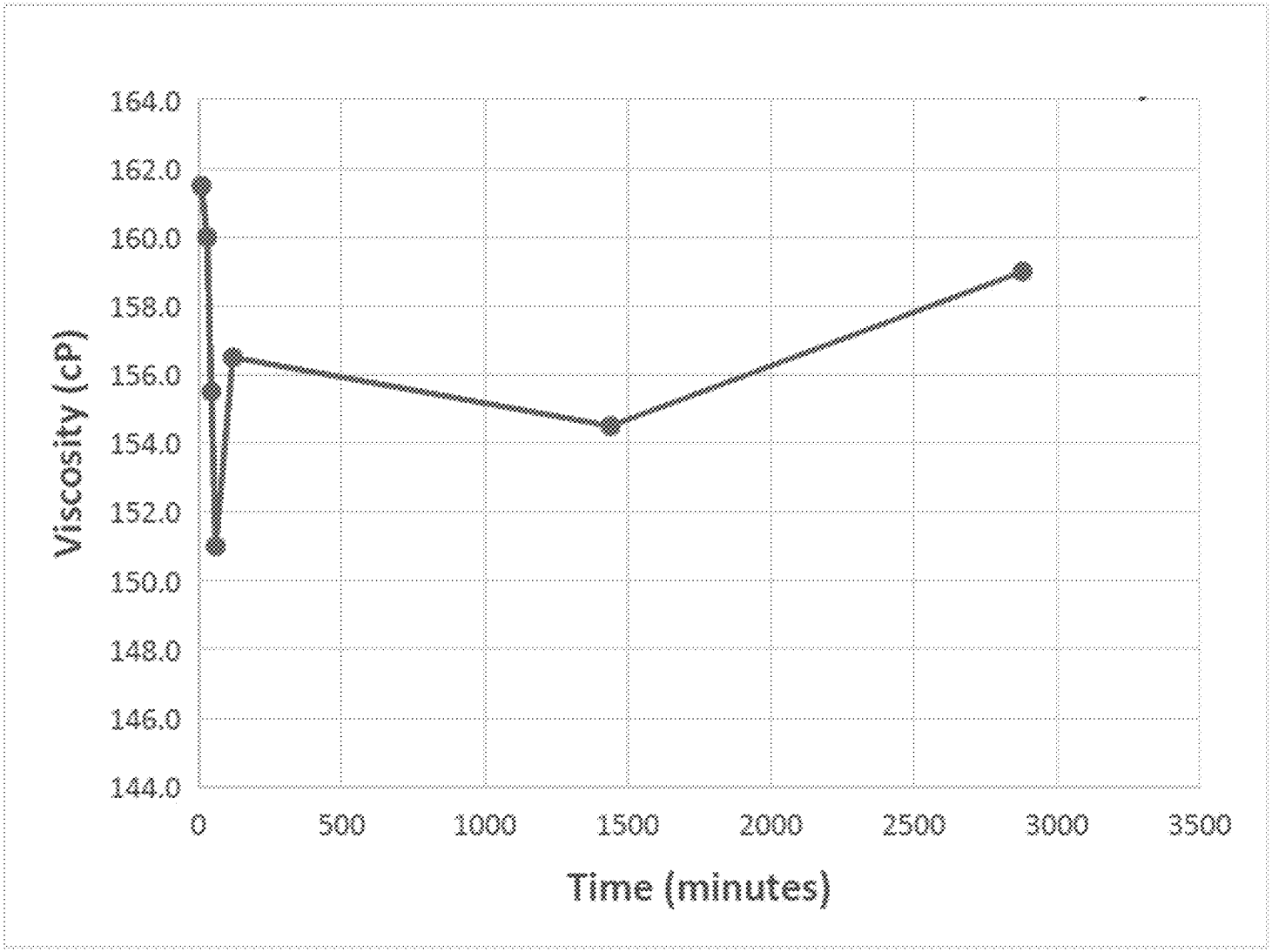
FIG. 2 is a graph showing the viscosity over time of Example 1 after blending with 70° F. water.

The viscosity over time of the final diluted product 202 of Example 1 after blending with 70° F. water is given in Table 6. The results are also shown in FIG. 2. The viscosity was measured using Brookfield rotational viscometer at 60 rpm. Spindle 2 was used for viscosity measurements between 1 and 500 centipoise and spindle 4 was used for viscosity measurements greater than 500 centipoise per USFS standards.

TABLE 6

Viscosity over time of the final diluted product 202 after blending with 70° F. water

| Time (minutes) | Viscosity (cP) | Temperature (° F.) |
|---|---|---|
| 10 | 161.5 | 70.0 |
| 30 | 160.0 | 70.2 |
| 45 | 155.5 | 70.2 |
| 60 | 151.0 | 70.0 |
| 120 | 156.5 | 70.3 |
| 150 | 391.2 | 75.5 |
| 1440 | 154.5 | 70.3 |
| 2880 | 159.0 | 70.2 |

Figure 3:
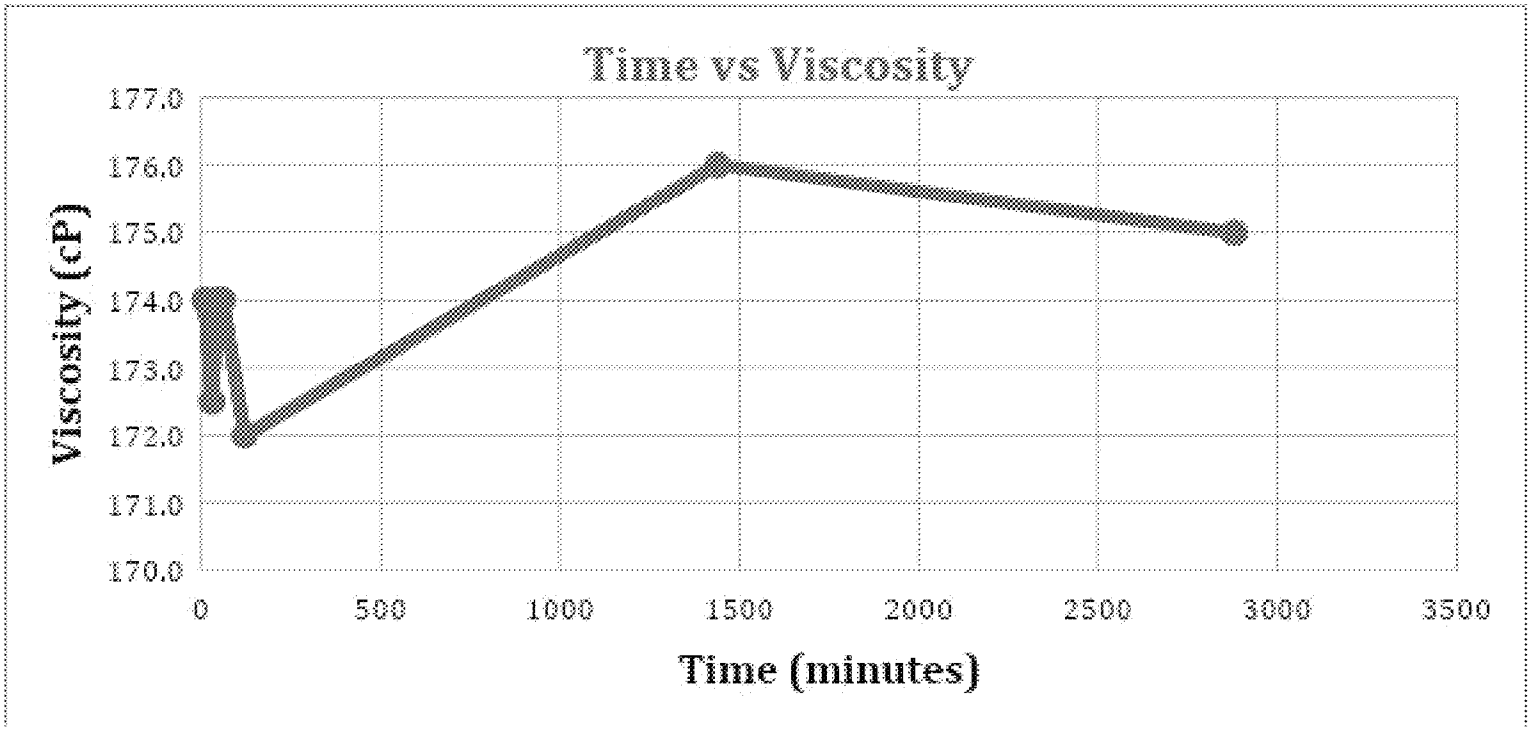
FIG. 3 is a graph showing the viscosity of the final diluted product of Example 1 maintained at 70° F.

The viscosity over time of the final diluted product 202 of Example 1 maintained at 70° F. water is given in Table 7. The results are also shown in FIG. 3.

TABLE 7

Viscosity over time of the final diluted product 202 maintained at 70° F.

| % Torque | Time (minutes) | Viscosity (cP) | Temperature (° F.) | Temperature (° C.) |
|---|---|---|---|---|
| 34.8 | 10 | 174.0 | 69.8 | 21.0 |
| 34.6 | 30 | 172.5 | 71.5 | 22.0 |
| 34.8 | 45 | 174.0 | 70.3 | 21.3 |
| 34.8 | 60 | 174.0 | 69.0 | 20.8 |
| 34.4 | 120 | 172.0 | 69.0 | 20.8 |
| 35.1 | 1440 | 176.0 | 69.2 | 20.7 |
| 35.0 | 2880 | 175.0 | 70.1 | 21.2 |

The viscosity over time of the final diluted product 202 of Example 1 after blending with 40° F. water is given in Table 8.

TABLE 8

Viscosity over time of the final diluted product 202 after blending with 40° F. water

| Time (minutes) | Viscosity (cP) | Temperature (° F.) |
|---|---|---|
| 10 | 185.0 | 57.2 |
| 30 | 178.0 | 60.0 |
| 60 | 175.0 | 62.2 |
| 120 | 168.0 | 64.5 |
| 1440 | 171.0 | 69.6 |
| 2880 | 176.0 | 65.8 |

The viscosity over time of the final diluted product 202 of Example 1 after blending with 70° F. water is given in Table 9.

TABLE 9

Viscosity over time of the final diluted product 202 after blending with 70° F. water

| Time (minutes) | Viscosity (cP) | Temperature (° F.) |
|---|---|---|
| 10 | 168.0 | 73.5 |
| 30 | 169.0 | 71.6 |
| 60 | 171.0 | 70.3 |
| 120 | 168.0 | 69.8 |
| 1440 | 172.0 | 68.3 |
| 2880 | 172.0 | 70.3 |

The viscosity over time of the final diluted product 202 of Example 1 after blending with 100° F. water is given in Table 10.

TABLE 10

Viscosity over time of the final diluted product 202 after blending with 100° F. water

| Time (minutes) | Viscosity (cP) | Temperature (° F.) |
|---|---|---|
| 10 | 157.0 | 84.0 |
| 30 | 159.0 | 82.0 |
| 60 | 160.0 | 78.6 |
| 120 | 161.0 | 73.9 |
| 1440 | 172.0 | 68.7 |
| 2880 | 174.0 | 68.0 |

The viscosity at 1 hour and 24 hours after mixing varying mix ratios of the final diluted product 202 of Example 1 with 70° F. water is given in Table 11. The measurements taken with spindle 62 at 60 RPM and 1 minute after the spindle is started. The concentrations were dissolved in tap water (378.94 g) at 69.5° F. The results are shown for 0.25, 0.5, 0.75 percent below the target mix ratio and 0.25, 0.5, and 0.75 percent above the target mix ratio of the forest fire retardant composition of Example 1. The starting water temperature for mixing was 70° F. The amount of liquid concentrate 201 used to prepare concentration is given in Table 11.

TABLE 11

Viscosity of final diluted product 202 versus the mix ratio

| Amount of Liquid Concentrate (g) | Percent Difference from Target Mix Ratio | Temperature (° F.) | Time (Hours) | Viscosity (cP) |
|---|---|---|---|---|
| 197.16 | −0.75% | 70.1 | 1 | 168.0 |
| 197.16 | −0.75% | 69.8 | 24 | 172.0 |
| 198.11 | −0.50% | 70.1 | 1 | 170.0 |
| 198.11 | −0.50% | 69.6 | 24 | 174.0 |
| 199.06 | −0.25% | 70.3 | 1 | 171.0 |
| 199.06 | −0.25% | 70.1 | 24 | 173.0 |
| 200.00 | 0.00% | 70.5 | 1 | 171.5 |
| 200.00 | 0.00% | 69.2 | 24 | 174.0 |
| 200.95 | 0.25% | 69.8 | 1 | 173.0 |
| 200.95 | 0.25% | 69.8 | 24 | 173.0 |
| 201.90 | 0.50% | 69.5 | 1 | 176.0 |
| 201.90 | 0.50% | 69.6 | 24 | 177.0 |
| 202.85 | 0.75% | 69.4 | 1 | 177.0 |
| 202.85 | 0.75% | 69.8 | 24 | 179.0 |

The forest fire retardant composition of Example 1 is a thixotropic mixture and has a time-dependent shear thinning property.

Example 2

In Example 2, a liquid concentrate 201 is prepared containing the amounts of ingredients listed in Table 12 below. The values in Table 12 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 12

Liquid Concentrate according to Example 2

| Ingredient | Weight Percent of Each Ingredient in Liquid Concentrate |
|---|---|
| 30% $Mg(OH)_2$ Solution | 96.78% |
| Thickening agent 1 - Polysaccharide gum | 0.69% |
| Colorant - Iron Oxide Black | 0.84% |
| $TiO_2$ | 0.28% |
| Triethanolamine ($C_6H_{15}NO_3$) | 0.58% |
| Corrosion inhibitor | 0.58% |
| Dye | 0.21% |
| SDS Surfactant | 0.04% |
| Total Weight of Liquid Concentrate | 100% |

In Example 2, a final diluted product 202 is prepared by mixing the liquid concentrate 201 with water in a weight ratio concentrate:water of about 1:1.895. In Example 2, approximately 1 pound of the liquid concentrate 201 is mixed with 1.895 pounds of water to prepare the Example 2 final diluted product 202. Alternatively, the final diluted product 202 can be prepared by mixing the liquid concentrate 201 with water in a volume ratio concentrate:water of about 1.0:0.5 to about 1.0:3.0.

In Example 2, the amounts of the ingredients in the final diluted product 202 are listed in Table 13 below. The values in Table 13 can be varied by ±0.01%, or ±0.05%, or ±0.1%, or ±0.5%, or +1.0%, or +1.5%, or +2%, or +2.5%, or ±3.0%, or ±3.5%, or ±4.0%, or ±4.5%, or ±5.0%.

TABLE 13

Final Diluted Product according to Example 2

| Ingredient | Weight Percent of Each Ingredient in Final Diluted Product |
|---|---|
| 30% $Mg(OH)_2$ Solution | 33.43% |
| Thickening agent 1 - Polysaccharide gum | 0.24% |
| Colorant - Iron Oxide Black | 0.29% |
| $TiO_2$ | 0.10% |
| Triethanolamine ($C_6H_{15}NO_3$) | 0.20% |
| Corrosion inhibitor | 0.20% |
| Dye | 0.07% |
| SDS Surfactant | 0.01% |
| Water | 65.46% |
| Total Weight of Liquid Concentrate | 100% |

In the final diluted product 202 of Example 2, the weight percent of metal hydroxide is about 1% to about 50%, preferably about 2% to about 40%, more preferably about 3% to about 30%. For example, the weight percent of metal hydroxide in final diluted product 202 is about 5% to about 20%, and specifically about 10%±1.0%.

Example 3

In Example 3, a liquid concentrate 201 is prepared containing the amounts of ingredients listed in Table 14 below. The values in Table 14 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 14

Liquid Concentrate according to Example 3

| Ingredient | Weight Percent of Each Ingredient in Liquid Concentrate |
|---|---|
| 30% Corrosion Inhibited $MgCl_2$ Solution | 99.19% |
| Thickening agent | 0.20% |
| Colorant | 0.00% |
| Magnesium Hydroxide | 0.20% |
| Adjuvants | 0.20% |
| Corrosion inhibitor | 0.00% |
| Dye | 0.21% |
| Water | 0.00% |
| Total Weight of Liquid Concentrate | 100% |

In Example 3, a final diluted product 202 is prepared by mixing the liquid concentrate 201 with water in a weight ratio concentrate:water of about 1:1. In Example 3, approximately 1 pound of the liquid concentrate 201 is mixed with 1 pound of water to prepare the Example 3 final diluted product 202. Alternatively, the final diluted product 202 can be prepared by mixing the liquid concentrate 201 with water in a volume ratio concentrate:water of about 1.0:0.25 to about 1.0:3.0.

In Example 3, the amounts of the ingredients in the final diluted product 202 are listed in Table 15 below. The values in Table 15 can be varied by ±0.01%, or ±0.05%, or ±0.1%, or ±0.5%, or +1.0%, or +1.5%, or +2%, or +2.5%, or ±3.0%, or ±3.5%, or ±4.0%, or ±4.5%, or ±5.0%.

TABLE 15

Final Diluted Product according to Example 3

| Ingredient | Weight Percent of Each Ingredient in Final Diluted Product |
|---|---|
| 30% Corrosion Inhibited $MgCl_2$ Solution | 49.60% |
| Thickening agent | 0.10% |
| Colorant | 0.00% |
| Magnesium Hydroxide | 0.10% |
| Adjuvants | 0.10% |
| Corrosion inhibitor | 0.00% |
| Dye | 0.11% |
| Water | 50.00% |
| Total Weight of Final Diluted Product | 100% |

In the final diluted product 202 of Example 3, the weight percent of magnesium chloride is about 4% to about 30%, preferably about 6% to about 25%, more preferably about 8% to about 20%. For example, the weight percent of magnesium chloride in final diluted product 202 is about 12% to about 18%, and specifically about 15%±1.0%.

The weight percent of adjuvants, relative to the amount of the retardant compound in the final diluted product 202 of Example 3, is about 0.005% to about 2%, preferably about 0.0075% to about 1.75%, more preferably about 0.01% to about 1.5%, and more specifically about 0.025% to about 1.25%. For example, the weight percent of adjuvants, relative to the amount of the retardant compound in the final diluted product 202 of Example 3, is about 0.05% to about 1.0%, and specifically about 0.67%±0.1%.

The fugitive dye will impart a visible tint to the forest fire retardant of Example 3 that will disappear with exposure to sunlight. The forest fire retardant composition of Example 3 is thickened with a thickening agent to increase spraying effectiveness, adhesion to fuel, and an increased surface tension over water. The viscosity of the final diluted product 202 of Example 3 may be in the range of 20-200 cPs, for example 50-100 cPs.

Example 4

In Example 4, a liquid concentrate 201 is prepared containing the amounts of ingredients listed in Table 16 below. The values in Table 16 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 16

Liquid Concentrate according to Example 4

| Ingredient | Weight Percent of Each Ingredient in Liquid Concentrate |
|---|---|
| 30% Non-corrosion Inhibited $MgCl_2$ Solution | 98.40% |
| Thickening agent | 0.30% |
| Colorant | 0.00% |
| Magnesium Hydroxide | 0.32% |
| Adjuvants | 0.58% |
| Corrosion inhibitor | 0.20% |
| Dye | 0.20% |
| Water | 0.00% |
| Total Weight of Liquid Concentrate | 100% |

In Example 4, a final diluted product 202 is prepared by mixing the liquid concentrate 201 with water in a weight ratio concentrate:water of about 1:2. In Example 4, approximately 1 pound of the liquid concentrate 201 is mixed with 2 pounds of water to prepare the Example 4 final diluted product 202. Alternatively, the final diluted product 202 can be prepared by mixing the liquid concentrate 201 with water in a volume ratio concentrate:water of about 1.0:0.5 to about 1.0:3.0.

In Example 4, the amounts of the ingredients in the final diluted product 202 are listed in Table 17 below. The values in Table 17 can be varied by ±0.01%, or ±0.05%, or ±0.1%, or ±0.5%, or +1.0%, or +1.5%, or +2%, or +2.5%, or ±3.0%, or ±3.5%, or ±4.0%, or ±4.5%, or ±5.0%.

TABLE 17

Final Diluted Product according to Example 4

| Ingredient | Weight Percent of Each Ingredient in Final Diluted Product |
|---|---|
| 30% Non-corrosion Inhibited $MgCl_2$ Solution | 32.80% |

TABLE 17-continued

Final Diluted Product according to Example 4

| Ingredient | Weight Percent of Each Ingredient in Final Diluted Product |
|---|---|
| Thickening agent | 0.10% |
| Colorant | 0.00% |
| Magnesium Hydroxide | 0.11% |
| Adjuvants | 0.19% |
| Corrosion inhibitor | 0.07% |
| Dye | 0.07% |
| Water | 66.67% |
| Total Weight of Final Diluted Product | 100% |

In the final diluted product 202 of Example 4, the weight percent of magnesium chloride is about 2% to about 20%, preferably about 3% to about 18%, more preferably about 4% to about 16%. For example, the weight percent of magnesium chloride in final diluted product 202 is about 5% to about 14%, and specifically about 10%±1.0%.

The weight percent of adjuvants, relative to the amount of the retardant compound in the final diluted product 202 of Example 4, is about 0.1% to about 3.0%, preferably about 0.2% to about 2.8%, more preferably about 0.3% to about 2.6%, and more specifically about 0.4% to about 2.4%. For example, the weight percent of adjuvants, relative to the amount of the retardant compound in the final diluted product 202 of Example 4, is about 0.5% to about 2.2%, and specifically about 1.9%±0.1%.

The fugitive dye will impart a visible tint to the forest fire retardant of Example 4 that will disappear with exposure to sunlight. The forest fire retardant composition of Example 4 is thickened with a thickening agent to increase spraying effectiveness, adhesion to fuel, and an increased surface tension over water. The viscosity of the final diluted product 202 of Example 4 may be in the range of 20-200 cPs, for example 50-100 cPs.

Example 5

In Example 5, a liquid concentrate 201 is prepared containing the amounts of ingredients listed in Table 18 below. The values in Table 18 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 18

Liquid Concentrate according to Example 5

| Ingredient | Weight Percent of Each Ingredient in Liquid Concentrate |
|---|---|
| 30% Corrosion Inhibited $MgCl_2$ Solution | 98.99% |
| Thickening agent | 0.20% |
| Pigment | 0.20% |
| Magnesium Hydroxide | 0.20% |
| Adjuvants | 0.20% |
| Corrosion inhibitor | 0.00% |
| Dye | 0.21% |
| Water | 0.00% |
| Total Weight of Liquid Concentrate | 100% |

In Example 5, a final diluted product 202 is prepared by mixing the liquid concentrate 201 with water in a weight ratio concentrate:water of about 1:1. In Example 5, approximately 1 pound of the liquid concentrate 201 is mixed with 1 pound of water to prepare the Example 5 final diluted product 202. Alternatively, the final diluted product 202 can be prepared by mixing the liquid concentrate 201 with water in a volume ratio concentrate:water of about 1.0:0.25 to about 1.0:3.0.

In Example 5, the amounts of the ingredients in the final diluted product 202 are listed in Table 19 below. The values in Table 19 can be varied by ±0.01%, or ±0.05%, or ±0.1%, or ±0.5%, or ±1.0%, or ±1.5%, or ±2%, or ±2.5%, or ±3.0%, or ±3.5%, or ±4.0%, or ±4.5%, or ±5.0%.

TABLE 19

Final Diluted Product according to Example 5

| Ingredient | Weight Percent of Each Ingredient in Final Diluted Product |
|---|---|
| 30% Corrosion Inhibited $MgCl_2$ Solution | 49.50% |
| Thickening agent | 0.10% |
| Pigment | 0.10% |
| Magnesium Hydroxide | 0.10% |
| Adjuvants | 0.10% |
| Corrosion inhibitor | 0.00% |
| Dye | 0.11% |
| Water | 50.00% |
| Total Weight of Final Diluted Product | 100% |

In the final diluted product 202 of Example 5, the weight percent of magnesium chloride is about 4% to about 30%, preferably about 6% to about 25%, more preferably about 8% to about 20%. For example, the weight percent of magnesium chloride in final diluted product 202 is about 12% to about 18%, and specifically about 15%±1.0%.

The weight percent of adjuvants, relative to the amount of the retardant compound in the final diluted product 202 of Example 5, is about 0.005% to about 2%, preferably about 0.0075% to about 1.75%, more preferably about 0.01% to about 1.5%, and more specifically about 0.025% to about 1.25%. For example, the weight percent of adjuvants, relative to the amount of the retardant compound in the final diluted product 202 of Example 5, is about 0.05% to about 1.0%, and specifically about 0.67%±0.1%.

The fugitive dye will impart a visible tint to the forest fire retardant of Example 5 that will disappear with exposure to sunlight. The forest fire retardant composition of Example 5 is thickened with a thickening agent to increase spraying effectiveness, adhesion to fuel, and an increased surface tension over water. The viscosity of the final diluted product 202 of Example 5 may be in the range of 20-200 cPs, for example 50-100 cPs.

Methods of Use

The forest fire retardant composition of Example 1 may be used to suppress, retard, or contain a forest fire. The forest fire retardant composition of Example 1 functions as a superior forest fire retardant and suppressant compared to the PHOS-CHEK® brand long-term fire retardants (LTR) which have previously been qualified for use by the USFS. A list of the PHOS-CHEK® USFS Qualified long-term fire retardants is given in Table 20.

TABLE 20

List of PHOS-CHEK ® USFS Qualified LTR Products

| USFS Qualified LTR Products List | Description |
|---|---|
| PHOS-CHEK ® MVP-Fx | Dry Concentrate, Gum-Thickened, High and Medium Viscosity, High Visibility, Fugitive Color |
| PHOS-CHEK ® MVP-F | Dry Concentrate, Gum-Thickened, High and Medium Viscosity, Standard Fugitive Color |
| PHOS-CHEK ® P100-F | Dry Concentrate, Gum-Thickened, High and Medium Viscosity |
| PHOS-CHEK ® 259-Fx | Dry Concentrate, Gum-thickened, Low Viscosity, High Visibility, Fixed Tank Helicopter Powder Concentrate |
| PHOS-CHEK ® 259-F | Dry Concentrate, Gum-thickened, Low Viscosity |
| PHOS-CHEK ® LC-95A-R | Wet Concentrate, Gum-Thickened, Low Viscosity |
| PHOS-CHEK ® LC-95A-Fx | Wet Concentrate, Gum-Thickened, Low Viscosity, High Visibility, Fugitive Color |
| PHOS-CHEK ® LC-95A-F | Wet Concentrate, Gum-Thickened, Low Viscosity |
| PHOS-CHEK ® LC-95-W | Wet Concentrate, Gum-Thickened, Low Viscosity, Red Iron Oxide, medium Viscosity Liquid Concentrate |

The forest fire retardant composition of Example 1 pulls energy out of forest fires at it converts the hydrates of the hydrated salt to free water. The salt is hydrated in the liquid concentrate 201, where the salt contains magnesium the most common hydrate is a hexahydrate. For example, when the final diluted composition 202 includes magnesium chloride hexahydrate, the final diluted composition 202 contains approximately 10% $MgCl_2$ concentration by weight. The weight of the final diluted composition 202 increases along with its efficiency. When the product of Example 1 is wet it functions as a fire suppressant. Once the final diluted composition 202 has dried after application, the magnesium chloride hexahydrate of the composition effectively retards continued combustion. Magnesium hydroxide interferes with the burning process through the release of inter gases (such as water vapor). In this process a protective char layer is formed or the amount of energy available for the spread of fire is reduced through energy absorption. Magnesium chloride hexahydrate is deliquescent, absorbing sufficient moisture from the air to form an aqueous solution. The critical relative humidity of magnesium chloride hexahydrate is 32%, independent of temperature. The critical relative humidity of Example 1 is approximately 33%. Example 1 is also self-rehydrating. The larger the difference between the relative humidity of the atmosphere and the critical relative humidity, the faster the water is rehydrated. Generally, the relative humidity on a wildland fire is lowest during the day and recovers during the night. In moderate burning condition, the nighttime relative humidity recovery will rise to 50%-70%. This is an environmental condition that exists almost every night on wildfires, thereby allowing magnesium chloride hexahydrate to absorb moisture from the air and pull it in to the fuel bed leading to its improved forest fire retardant capabilities. The forest fire retardant of Example 1 will start to recover water at a lower relative humidity and recover for a longer time every burning period. Calcium chloride has a similar retarding efficiency to magnesium chloride. Further, calcium chloride saturates in solution at about 40% salt concentration resulting in a higher salt concentration in solution, whereas magnesium chloride saturates at 33% salt concentration. Thus, calcium chloride has potential use as a long-term liquid fire retardant alone or in combination with magnesium chloride. Aluminum hydroxide functions in a similar mechanism to magnesium hydroxide and has potential use as a long-term fire retardant alone or in combination with magnesium hydroxide.

By contrast, the PHOS-CHEK® LTR products of Table 20 need to dry and require heat to produce a carbon coating that buffers the flammable vegetation from the fire's heat and slows the fire spread. Diammonium phosphate (DAP), an ingredient in PHOS-CHEK® LTR products, is semi-hygroscopic and does not absorb sufficient moisture from the air to form an aqueous solution. The critical relative humidity of DAP, a component in PHOS-CHEK® LTR products is 82%, an environmental situation that almost never occurs on a wildland fire, rendering its ability to pull moisture from the air meaningless. DAP is a man-made chemical produced in a factory.

The magnesium chloride hexahydrate in the composition of Example 1 contains six water molecules. Under heat, the six water molecules thermally dehydrate in pairs at progressively higher temperatures: 6 at 243° F., 4 at 358° F. and 2 at 572° F. The first water molecules are released at 243° F., which is above the temperature produced by solar heating, and below the ignition temperature of forest fuels. By contrast, the fire retardant ingredients in PHOS-CHEK® LTR products of Table 20 contain no water molecules. When cellulose fuels are burned in the presence of PHOS-CHEK® LTR products, hydrogen and oxygen both from the cellulose combine to form water. This requires that the fuel must already be burning for this water to form, thereby limiting the effectiveness of PHOS-CHEK® LTR products as a forest fire retardant. This progressive release of water molecules consumes heat, resulting in an endothermic compound that absorbs heat from the flame front. At over 1317° F., the $MgCl_2$ compound dissociates into magnesium and chloride ions.

The forest fire retardant composition of Example 1 relies on a vapor phase radical quenching process. The vapor phase inhibition aims to interrupt the radical gas phase of a fire. By disrupting the phase in which flammable gas is released the system is cooled and the supply of flammable gas is reduced or suppressed. Under heat attack from a wildland fire, but just below the temperature that forest fuels begin to actively burn (523° F.), the magnesium chloride compound in the composition of Example 1 dissociates, and the chloride ion separates from the magnesium to produce $Mg^{++}+2Cl^{-}$. The chloride atoms are released into the gas phase before the material reaches its ignition temperature. The chloride ion is very aggressive and will displace other, less aggressive ions normally active in the rapid chain reaction that occurs just prior to active fire. The chloride ions quench the chemical reaction occurring within the flame and either extinguish the fire or slow the spread of the fire such that there is increased escape time or increased time to attempt other means of fire extinction. The chain reaction interference results in a diverted outcome of the combustion chain reaction and preventing the start of a fire. The chloride ion and six additional water molecules are present in the combustion atmosphere and are effective in retarding fire in the general fire area, not just on the coated fuels. In the PHOS-CHEK® LTR products, by contrast, the fire retardation occurs when the LTR produces a protective and insulating layer of carbon. The vegetation to be protected must be coated. Thus, effectiveness of PHOS-CHEK® LTR products is limited only to the fuels that are coated with the product.

The forest fire retardant composition of Example 2 pulls energy out of forest fires as it releases inter gases (such as water vapor). In a forest fire, the magnesium hydroxide in the forest fire retardant composition of Example 2 undergoes endothermic decomposition, which lessens thermal decomposition of the forest's combustible biomass that acts as fuel. The product of endothermic decomposition of magnesium hydroxide is water vapor and magnesium oxide. The water vapor dilutes the concentration of flammable gases, such as oxygen. In this process a protective char layer is formed and the amount of energy available for the spread of fire is reduced.

Direct Attack

In a direct attack, the final diluted composition 202 is applied on the fire line. The final diluted composition 202 is a thickened water suppressant which contains water to cool and suppress the fire. For example, when the final diluted composition 202 includes magnesium chloride hexahydrate, the water molecules of the magnesium chloride hexahydrate thermally dehydrate at 243° F., 358° F., and 572° F. in an endothermic reaction, absorbing heat from the fire as the reaction progresses and lowering the temperature of the flame front. At over 1317° F., the $MgCl_2$ compound dissociates into magnesium and chloride ions. The chloride ions work to displace the rapid oxidation reactions that occur during the fire. Fire is a rapid oxidation chain reaction. Chloride is an aggressive ion that will flood the combustion chain reaction process of the fire to slow the fire line.

Indirect Attack

In an indirect attack, the final diluted composition 202 is applied in fire containment lines at a significant distance from the fire line. The indirect fire lines are built, and the fire is allowed to burn into them. The long-term fire retardant must be effective even after the water in the composition has evaporated. The final diluted composition 202 is hygroscopic and self-rehydrating. In an indirect attack, the final diluted composition 202 is applied to vegetation. As the water in the final diluted composition 202 evaporates, the salt concentration increases until it reaches its saturation level. For example, when the final diluted composition 202 includes magnesium chloride hexahydrate, the saturation level is about 30% to 35% salt concentration, preferably about 31% to 34% salt concentration, and more preferably about 33% salt concentration. At the saturation level, hydrated $MgCl_2$—$(H_2O)_6$ forms which can act as a long-term fire retardant when exposed to the heat of the fire. When the flame front reaches vegetation treated with the final diluted composition 202, the hydrated water molecules cleave-off in pairs at 243° F., 358° F. and 572° F. in an endothermic reaction, absorbing heat from the fire as the reaction progresses and lowering the temperature of the flame front. The chloride ions will dissociate at 1317° F. and slow the combustion chain reaction process of the fire.

The forest fire retardant compositions of Examples 3, 4, and 5 may be used as a ground applied forest fire retardant for indirect attack. The forest fire retardant compositions of Examples 3, 4, and 5 may be suitable for application with spray equipment. The forest fire retardant compositions of Examples 3, 4, and 5 may be resistant to washing off in light rainfall and may also be conditioned for enhanced penetration in dead fuel.

Field Handling and Measurement

The forest fire retardant composition of Example 1 can be delivered to the field either as the liquid concentrate 201 or as the final diluted composition 202. The final diluted composition 202 can be tested prior to application in the field to confirm proper salt content. For example, when the final diluted composition 202 includes magnesium chloride hexahydrate, the magnesium chloride yields between 8.0% and 12% salt by weight, and preferably about 10.0% salt by weight in the final diluted composition 202. A refractometer can be used to test the salt content. Preferably the refractometer reading is about 1.1 to about 1.5, more preferably the refractometer reading is about 1.2 to about 1.4. For example, the refractometer reading is about 1.35 to about 1.37. Density can also be used to determine the salt content. Preferably the density is about 0.8 g/mL to 1.4 g/mL, more preferably the density is about 0.9 g/mL to about 1.2 g/mL. For example, the density is about 1.0 g/mL to about 1.1 g/mL Field Mixing Procedures and Ratios Batch preparation of final diluted composition 202 may be accomplished by slowly feeding the liquid concentrate into a well-stirred mix tank containing a predetermined amount of water. Mix tank agitation may be provided via an overhead mechanical stirring apparatus or alternatively by a circulation pump sized to provide turbulent mixing. Stir until the concentrate is uniformly mixed into the water. Alternatively, the final diluted composition 202 may be mixed using continuous mixing equipment.

For example, a 1500-gallon tank can be charged with 1000 gallons (8345 pounds) of water. The tank is agitated to provide efficient mixing, then 1998.074 kg (4405 pounds) of the liquid concentrate 201 are added. The addition rate is limited by the efficiency of the mixing system. In bulk mixing the addition rate should be limited to prevent concentrate pooling in the bottom of the mix tank. The resulting mixture will provide 5783.3 kg (12,750 pounds) and approximately 1400 gallons of the final diluted composition 202.

Aerial Application

The final diluted composition 202 may be deposited via aerial application from an airplane or helicopter. The airplane may be a fixed-wing multi-engine aircraft, a fixed-wing single engine airtanker (SEAT), a large airtanker (LAT), a very large airtanker (VLAT), or an unmanned aircraft system (UAS). The helicopter may be a fixed-tank helicopter (HF) or it may be a helicopter bucket (HB). The final diluted composition 202 may be deposited in an indirect attack to build a retardant line before a forest fire or directly to a forest fire via aerial application. In particular, a final diluted composition 202 containing calcium chloride may be used in fixed-tank helicopters, given calcium chloride's higher saturation percentage.

Ground Application

The final diluted composition 202 may be deposited via ground application from a truck or ground engine (G). The final diluted composition 202 may be deposited in an indirect attack to build a retardant line before a forest fire or it may be deposited directly to a forest fire via ground application.

Clean Up Procedure

The liquid concentrate 201 can be cleaned by flushing with water and capturing the rinse in a tank or disposal container via drains. The liquid concentrate 201 and the final diluted composition 202 can be cleaned with soap or liquid detergent and water. The color of the dye can be neutralized by a bleaching agent such as sodium hypochlorite or washed with liquid detergent.

CONCLUSION

All parameters, dimensions, materials, and configurations described herein are meant to be exemplary and the actual parameters, dimensions, materials, and/or configurations will depend upon the specific application or applications for which the inventive teachings is/are used. It is to be understood that the foregoing embodiments are presented primarily by way of example and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein.

In addition, any combination of two or more such features, systems, articles, materials, kits, and/or methods, if such features, systems, articles, materials, kits, and/or methods are not mutually inconsistent, is included within the inventive scope of the present disclosure. Other substitutions, modifications, changes, and omissions may be made in the design, operating conditions and arrangement of respective elements of the exemplary implementations without departing from the scope of the present disclosure. The use of a numerical range does not preclude equivalents that fall outside the range that fulfill the same function, in the same way, to produce the same result.

Also, various inventive concepts may be embodied as one or more methods, of which at least one example has been provided. The acts performed as part of the method may in some instances be ordered in different ways. Accordingly, in some inventive implementations, respective acts of a given method may be performed in an order different than specifically illustrated, which may include performing some acts simultaneously (even if such acts are shown as sequential acts in illustrative embodiments).

All publications, patent applications, patents, and other references mentioned herein are incorporated by reference in their entirety.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

In the claims, as well as in the specification, any ingredient listed in an open-ended list of ingredients shall not be negated or avoided by the addition of water or other solvent or reactant that might cause a chemical change to such ingredient. Thus, for example, even though it is known that an anhydrous salt becomes hydrated in the presence of water, the inventors hereby act as their own lexicographers, so that any composition "including" or "comprising" an "anhydrous" salt is intended to cover both a dry composition substantially free of water in which the salt has substantially no water of hydration, as well as any wet composition formed by the addition of water which causes the anhydrous salt to become hydrated (or to undergo some other change). Both before and after the addition of water or other ingredient, the composition shall be regarded, for purposes of the specification and claims, as comprising an "anhydrous" salt irrespective of any hydration, solvation, or other change caused by the addition of water or other ingredient. The same applies for any ingredient recited in an open-ended list which might be chemically changed by the addition of water or other ingredient to the open-ended list.

The invention claimed is:

1. A forest fire retardant liquid concentrate, comprising:

a magnesium salt solution comprising a magnesium salt dissolved in water, the magnesium salt being present in the solution in an amount having a weight percent of about 25% to about 35% relative to the total weight of the solution, and the solution being present in the liquid concentrate in an amount having a weight percent of about 85% to about 99% relative to the total weight of the liquid concentrate;

a corrosion inhibitor for at least one of iron, brass, or aluminum, present in the liquid concentrate in an amount having a weight percent of about 0.25% to about 5.0% relative to the weight of the magnesium salt in the liquid concentrate;

a thickening agent, present in the liquid concentrate in an amount having a weight percent of about 0.75% to about 5.0% relative to the weight of the magnesium salt in the liquid concentrate;

a buffering agent, present in the liquid concentrate in an amount having a weight percent of about 0.25% to about 5.0% relative to the weight of the magnesium salt in the liquid concentrate;

a colorant, present in the liquid concentrate in an amount having a weight percent of about 1.25% to about 4.5% relative to the weight of the magnesium salt in the liquid concentrate.

2. The liquid concentrate of claim 1, wherein the magnesium salt comprises magnesium chloride.

3. The liquid concentrate of claim 2, wherein the magnesium chloride is present in the liquid concentrate in an amount having a weight percent of about 26% to about 33% relative to the total weight of the liquid concentrate.

4. The liquid concentrate of claim 1, further comprising a pigment, present in the liquid concentrate in an amount having a weight percent of about 0.1% to about 2.0% relative to the weight of the magnesium salt in the liquid concentrate.

5. The liquid concentrate of claim 1, wherein the colorant comprises a fluorescent pigment.

6. The liquid concentrate of claim 1, wherein the thickening agent comprises a polysaccharide gum.

7. The liquid concentrate of claim 1, wherein the buffering agent comprises triethanolamine.

8. The liquid concentrate of claim 1, wherein the corrosion inhibitor comprises one or more azoles.

9. The liquid concentrate of claim 1, further comprising a glow-in-the-dark additive.

10. The liquid concentrate of claim 9, wherein the glow-in-the-dark additive comprises at least one of LumiNova, LumiNova Green (G), LumiNova G PS-2, LumiNova Blue Green (BG), a zinc sulfide pigment, or a fluorophore.

11. The liquid concentrate of claim 10, wherein the glow-in-the-dark additive comprises a fluorophore comprising at least one of CH1055 (4.8-Bis(2-(4-(bis(4-(2-carboxyethyl)phenyl)amino)phenyl)-5H-[1,2,5]thiadiazolo[3,4-f] benzo[c][1,2,5]thiadiazole), Cy7 or Cy7.5.

12. The liquid concentrate of claim 1, further comprising:

a fluorescent pigment; and a glow-in-the-dark additive.

13. A kit comprising:

a sealed container which contains the liquid concentrate of claim 1 substantially in the absence of external moisture; and instructions for using the liquid concentrate to make a final diluted product useful to suppress, retard, or contain forest fires.

14. A forest fire composition comprising:

the liquid concentrate of claim 1; and water;

wherein:

the forest fire composition is a final diluted product useful to suppress, retard, or contain forest fires; and the magnesium salt solution is present in the final diluted product in an amount having a weight percent of about 2% to about 30% relative to the total weight of the final diluted product.

* * * * *